US008328894B2

(12) United States Patent
Thurin et al.

(10) Patent No.: US 8,328,894 B2
(45) Date of Patent: Dec. 11, 2012

(54) DUST PREVENTION AND REMOVAL DEVICE

(75) Inventors: Matthew N. Thurin, Wauwatosa, WI (US); Jeremy F. Knopow, Burlington, WI (US); Patrick C. Sanders, West Bend, WI (US); Julie L. Bates, Franklin, WI (US); David H. Leifheit, Racine, WI (US); Nitin Sharma, Kenosha, WI (US); John R. Wietfeldt, Franksville, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 503 days.

(21) Appl. No.: 12/544,393

(22) Filed: Aug. 20, 2009

(65) Prior Publication Data

US 2010/0064895 A1 Mar. 18, 2010

Related U.S. Application Data

(60) Provisional application No. 61/115,409, filed on Nov. 17, 2008, provisional application No. 61/090,372, filed on Aug. 20, 2008.

(51) Int. Cl.
*B01D 51/00* (2006.01)

(52) U.S. Cl. ..... 55/467; 55/471; 55/490

(58) Field of Classification Search ..... 55/414–417, 55/167, 496–497, 506, 471; 96/134, 222, 96/399; 415/77, 220; 95/273
See application file for complete search history.

(56) References Cited

U.S. PATENT DOCUMENTS

| | | | | |
|---|---|---|---|---|
| 1,875,471 | A * | 9/1932 | Lowther | 261/121.1 |
| 4,121,916 | A | 10/1978 | Fricke | |
| 4,214,882 | A | 7/1980 | Brenholt | |
| 4,272,261 | A | 6/1981 | Lynch, Jr. et al. | |
| 4,846,859 | A | 7/1989 | Nobiraki et al. | |
| 5,069,691 | A | 12/1991 | Travis et al. | |
| 5,118,252 | A | 6/1992 | Chaney | |
| 5,230,723 | A | 7/1993 | Travis et al. | |
| 5,240,478 | A | 8/1993 | Messina | |

(Continued)

FOREIGN PATENT DOCUMENTS

GB 2420083 A * 5/2006

(Continued)

OTHER PUBLICATIONS

PCT/US2009/004737 International Search Report and Written Opinion dated Nov. 2, 2009.

*Primary Examiner* — Duane Smith
*Assistant Examiner* — Karla Hawkins

(57) ABSTRACT

A device is provided that is capable of circulating air throughout a personal space as well as collecting and preventing the build up of dust and other particulate matter by drawing in air from the surrounding environment and removing some dust, allergens and other such particulate matter therefrom. The filtered air is then expelled out of the device and back into the surrounding environment. The device includes a housing defining an interior space having a motor and fan assembly disposed therein. The housing includes an inlet with a filter provided therein such that air drawn in through the inlet is filtered. The air is then expelled through a circumferentially disposed outlet. The filter element preferably includes a lock and key system configured to prevent operation of the device in the absence of a properly keyed filter.

20 Claims, 39 Drawing Sheets

U.S. PATENT DOCUMENTS 5,268,009 A 12/1993 Thompson et al.
5,358,443 A 10/1994 Mitchell et al.
5,399,319 A 3/1995 Schoenberger et al.
D359,800 S 6/1995 Cich, Jr. et al.
5,435,817 A 7/1995 Davis et al.
5,616,172 A 4/1997 Tuckerman et al.
5,641,343 A 6/1997 Frey
5,753,000 A 5/1998 Chiu et al.
5,753,563 A 5/1998 Guan et al.
D397,201 S 8/1998 Ediger et al.
5,803,940 A 9/1998 Rick et al.
5,837,020 A 11/1998 Cartellone
5,840,092 A 11/1998 Rick et al.
5,925,172 A 7/1999 Rick et al.
5,925,320 A 7/1999 Jones
5,997,619 A 12/1999 Knuth et al.
6,017,375 A 1/2000 Duell et al.
6,036,757 A 3/2000 Gatchell et al.
6,053,968 A 4/2000 Miller
6,126,729 A 10/2000 Smith
6,156,085 A 12/2000 Chiu et al.
6,217,627 B1 4/2001 Vyskocil et al.
6,315,821 B1 11/2001 Pillion et al.
6,328,791 B1 12/2001 Pillion et al.
6,344,065 B1 2/2002 Boulva
6,361,590 B1 3/2002 Gilbert, Jr. et al.
D456,505 S 4/2002 Wolf et al.
6,413,302 B1 7/2002 Harrison et al.
6,447,587 B1 9/2002 Pillion et al.
6,508,868 B2 1/2003 Pillion et al.
6,511,531 B1 1/2003 Cartellone
6,551,185 B1 4/2003 Miyake et al.
6,585,792 B2 7/2003 Schneider et al.
6,616,722 B1 9/2003 Cartellone
6,616,736 B2 9/2003 Massey et al.
6,645,266 B2 11/2003 Huang
6,660,070 B2 12/2003 Chung et al.
6,695,577 B1 2/2004 Susek
6,695,891 B2 2/2004 Reid
6,702,879 B2 3/2004 Yokoyama et al.
6,712,889 B2 3/2004 Pillion et al.
6,749,654 B2 6/2004 Hilliard
D495,043 S 8/2004 Gatchell et al.
D497,985 S 11/2004 Christianson
6,821,310 B2 11/2004 Hedstrom
6,863,704 B2 3/2005 Pillion et al.
D509,292 S 9/2005 Gatchell et al.
6,942,711 B2 9/2005 Faulkner et al.
D512,495 S 12/2005 Russak et al.
D513,313 S 12/2005 Russak et al.
D513,431 S 1/2006 Russak et al.
6,989,051 B2 1/2006 Parisi et al.
D515,189 S 2/2006 Russak et al.
7,015,158 B2 3/2006 Pearce et al.
7,025,798 B2 4/2006 Endo
D525,691 S 7/2006 Russak et al.
D525,692 S 7/2006 Russak et al.
7,074,261 B2 7/2006 Murphy
D527,086 S 8/2006 Russak et al.
7,112,232 B2 9/2006 Chang et al.
D555,777 S 11/2007 Aveldson et al.
7,381,669 B2 6/2008 Pearce et al.
7,404,231 B2 7/2008 Kang
7,450,367 B2 11/2008 Frank et al.
2002/0152894 A1 10/2002 Pillion et al.
2002/0182053 A1* 12/2002 Miyazawa ..... 415/77
2004/0107358 A1* 6/2004 Shiakallis ..... 713/200
2004/0110850 A1 6/2004 Jordan et al.
2005/0055990 A1 3/2005 Choi et al.
2005/0160914 A1 7/2005 Hsieh
2005/0183576 A1 8/2005 Taylor et al.
2005/0195600 A1 9/2005 Porchia et al.
2006/0016335 A1 1/2006 Cox et al.
2006/0032199 A1 2/2006 Beam et al.
2006/0053758 A1 3/2006 Wu et al.
2006/0130657 A1 6/2006 Bohlen et al.
2006/0158138 A1 7/2006 Walter et al.
2006/0176693 A1 8/2006 Walter et al.
2007/0084162 A1 4/2007 Seipler
2007/0175195 A1* 8/2007 Skirius et al. ..... 55/527
2007/0277487 A1* 12/2007 Thurin et al. ..... 55/471
2008/0172818 A1 7/2008 Yoo
2008/0256744 A1* 10/2008 Rowntreer et al. ..... 15/350

FOREIGN PATENT DOCUMENTS

JP 55039224 3/1980
JP 09122419 5/1997
WO WO 2007/084953 7/2007
WO 2007/143455 A 12/2007
WO WO2008/049831 5/2008

* cited by examiner

DUST PREVENTION AND REMOVAL DEVICE

CROSS-REFERENCE TO RELATED APPLICATIONS

This application claims priority of U.S. Provisional Application Ser. No. 61/115,409, filed Nov. 17, 2008, and U.S. Provisional Application No. 61/090,372, filed Aug. 20, 2008, the entirety of each is incorporated herein by reference.

BACKGROUND OF THE INVENTION

1. Field of the Invention

The present invention relates to dust prevention and removal devices, and, more specifically, to a device for collecting and removing dust and allergens from the air and surrounding environment.

2. Discussion of the Related Art

In many household environments, a number of airborne particulates, e.g., allergens, dust and/or other airborne matter are present which can create respiratory problems for individuals residing within the home. Some such airborne particulates can accumulate on various readily viewable surfaces within the home, which can be aesthetically displeasing.

To manage, control, or otherwise influence the airborne travel or accumulation of airborne particulates, numerous known devices and procedures are utilized. As a first example, a number of different dust removal and collection devices have been developed that draw the air from the interior environments of the home or surrounding area through the device in order to filter and remove allergens, dust or other airborne particulates from the airflow passing through the device.

However, the vast majority of devices of this type have relatively complex constructions that require significant time and expense to assemble and maintain. In addition, the size and air handling capabilities of many prior art purification devices are suited for removing dust and allergens from an interior much larger than a single room or work space.

Therefore, it is desirable to develop a dust prevention and removal device that has a simple and easy to use construction, and which can be utilized to purify air in individual areas or personal spaces in rooms, or other smaller areas.

Further, it is desirable to develop a relatively small, preferably portable, device which mitigates or sufficiently removes a number of airborne particulates while only occupying a relatively small surface area.

In addition, it is desirable to provide a dust prevention and removal device that is configured to substantially reduce the amount of hand dusting required to maintain a clean surrounding environment and/or surface.

SUMMARY AND OBJECTS OF THE INVENTION

The dust prevention and removal device of the present invention removes dust, allergens, and other particulate material from the air and surfaces proximate the device, so that the user dusts less often. The device comprises a housing defining an interior space. The housing includes an inlet with a filter disposed therein for drawing air through and an outlet for expelling air. The interior space includes a motor in communication with a power source for delivering and powering thereof. The motor includes an output shaft in communication with a double-sided radial fan for driving the fan. The double-sided radial fan includes an upper portion having a plurality of blades disposed thereon and a lower portion having a plurality of blades disposed thereon. The fan vertically draws air through the inlet and filter to remove some dust, allergens and other particulate matter therefrom. The air is circulated within the interior of the housing where the airflow is rotated 90 degrees to a substantially horizontal airflow wherein it is circumferentially disposed out of the device through the outlet thereof. In a preferred embodiment of the present invention, the outlet airflow is directed onto the surrounding surface substantially reducing the amount of dust on the nearby surface.

The filter element of the present invention is preferably a thermoformed nonwoven filter capable of trapping some dust, allergens and other particulate matter present in the air. The filter is substantially visible, but not obtrusive, so the user can determine that the filter is collecting dust and change the filter when it becomes saturated with particulate matter. Further, the filter element is preferably disposable such that once the filter element becomes substantially dirty; it may be easily replaced by the user.

In a preferred embodiment of the present invention, the filter element comprises a lock and key element disposed thereon. The lock and key element is configured to mate with or otherwise communicate with a corresponding element disposed within the housing whereby removal of the filter or insertion of a filter element lacking the appropriate lock and key configuration prevents the device from operating.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
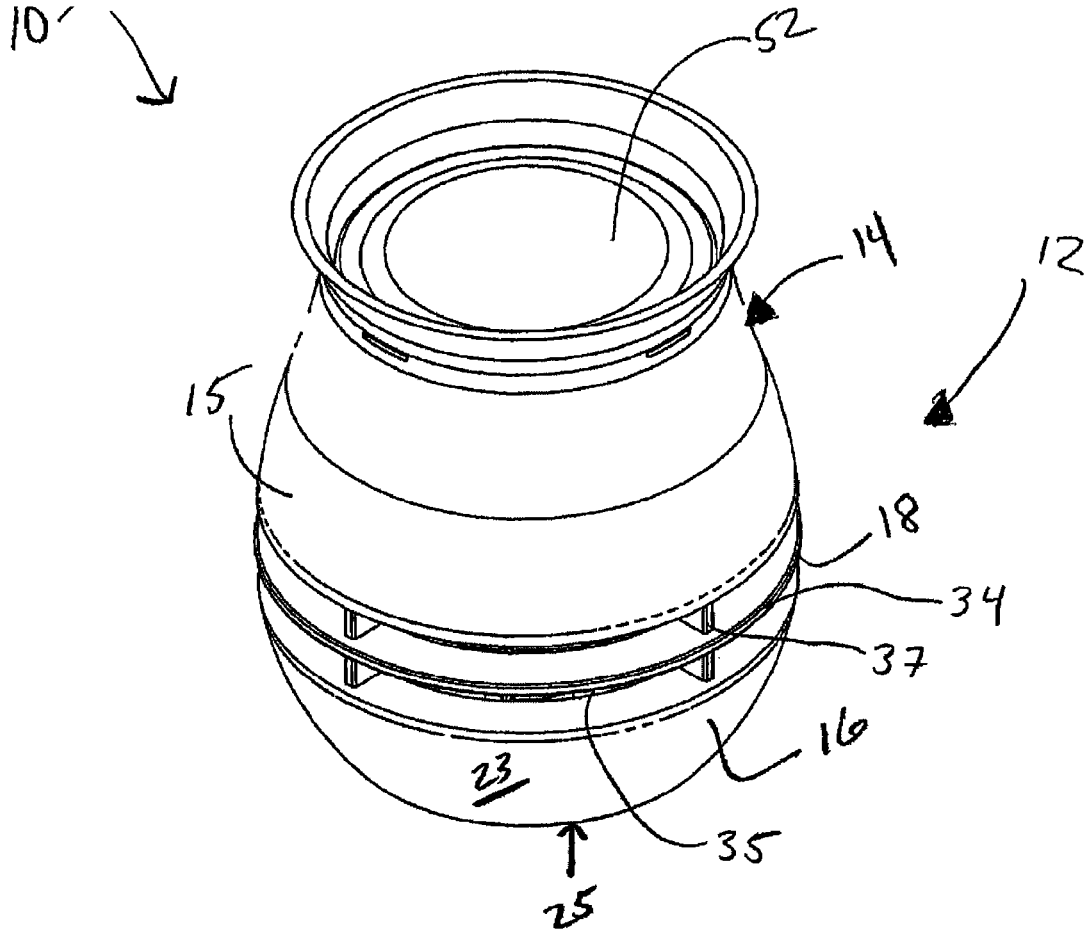
FIG. 1 is an isometric view of the dust prevention and removal device of the present invention.
Figure 2:
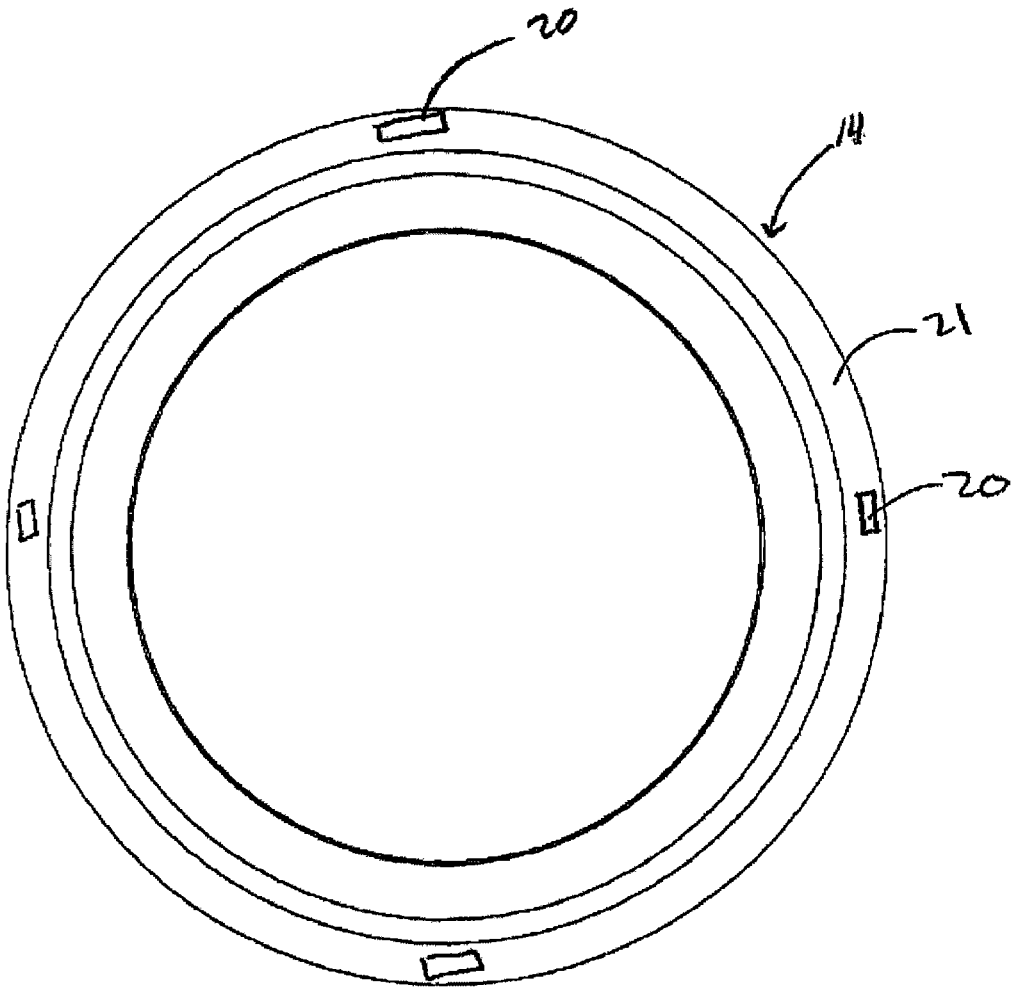
FIG. 2 is a top plan view of a top portion of a housing of the dust prevention and removal device of the present invention.
Figure 3:
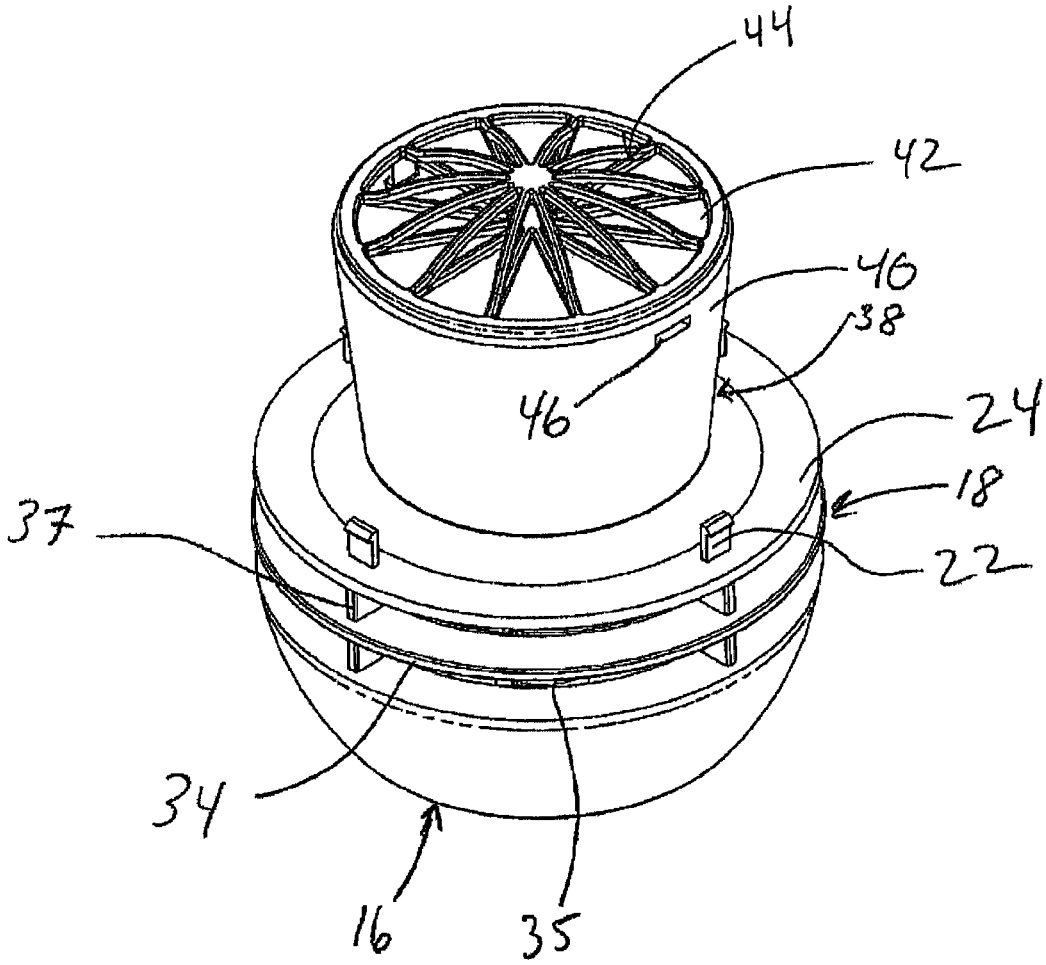
FIG. 3 is a partial isometric view of the dust prevention and removal device of the present invention.
Figure 4:
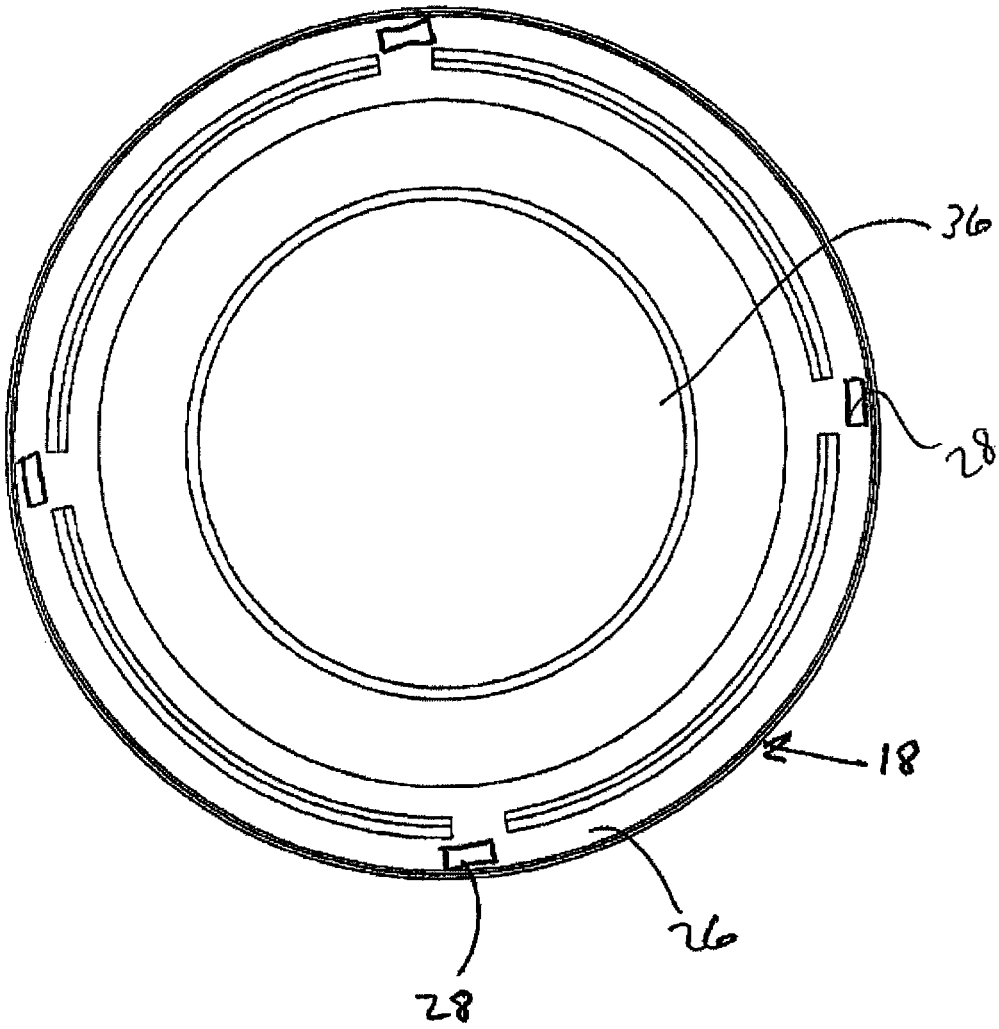
FIG. 4 is a top plan view of a bottom of the top portion of the housing of the dust prevention and removal device of the present invention.
Figure 5:
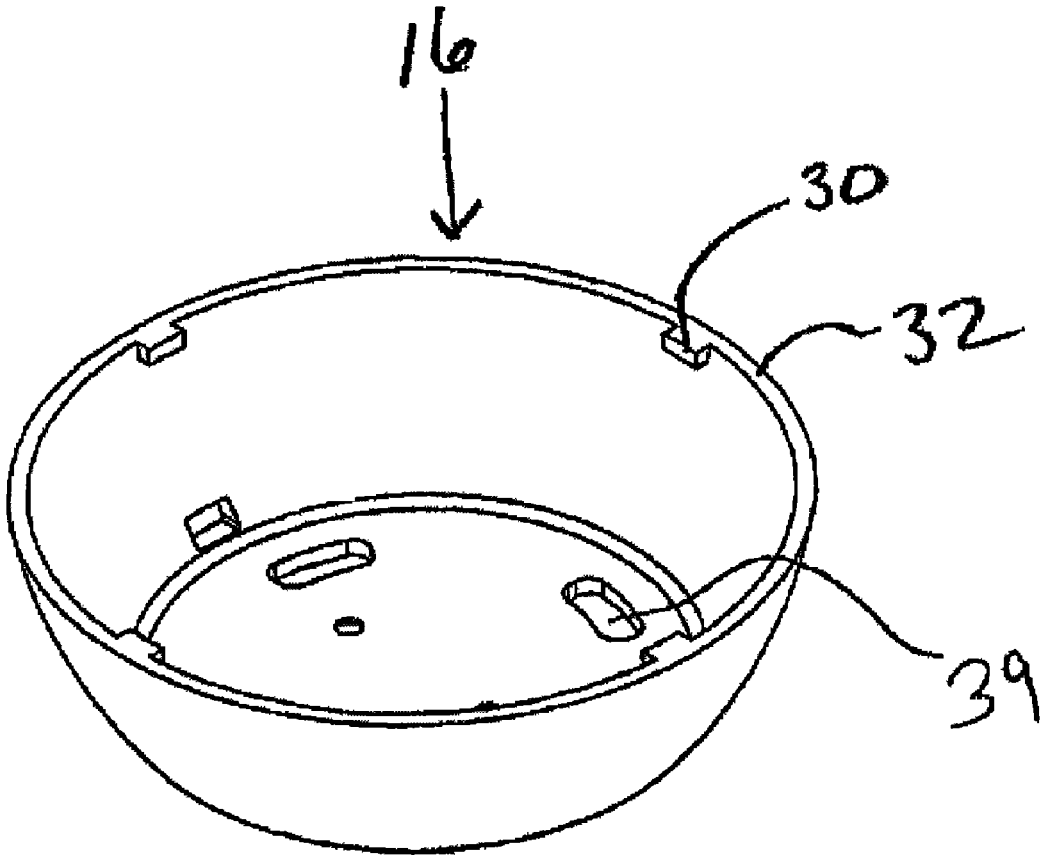
FIG. 5 is an isometric view of a bottom portion of the housing of the dust prevention and removal device of the present invention.
Figure 6:
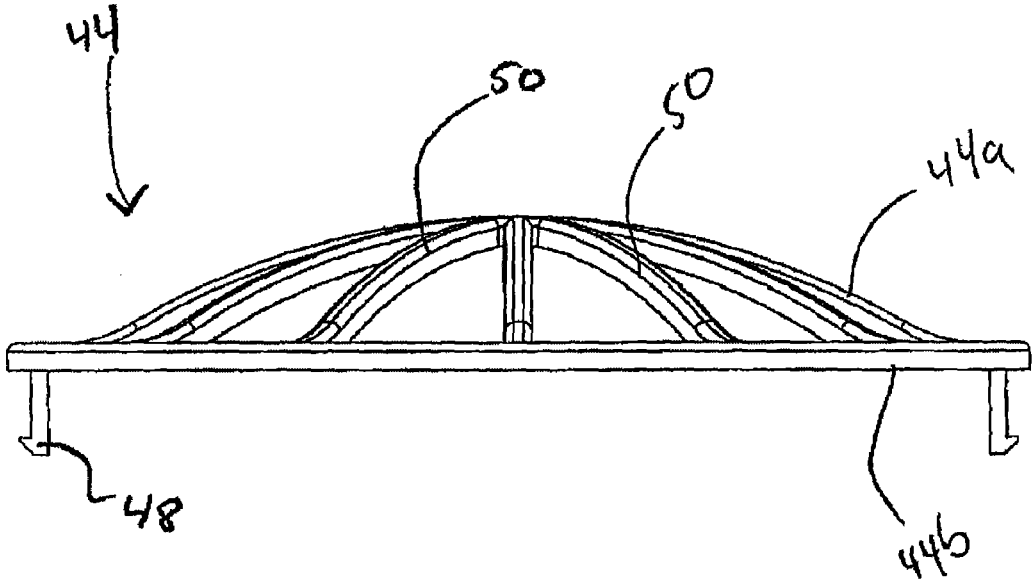
FIG. 6 is an elevation view of an inlet grill of the dust prevention and removal device of the present invention.

In describing the preferred embodiments of the invention, which are illustrated in the drawings, specific terminology will be resorted to for the sake of clarity. However, it is not intended that the invention be limited to the specific terms so selected and it is to be understood that each specific term includes all technical equivalents, which operate in a similar manner to accomplish a similar purpose. For example, the words connected, attached, or terms similar thereto are often used. However, they are not limited to direct connection but include connection through other elements where such connection is recognized as being equivalent by those skilled in the art.

DETAILED DESCRIPTION OF THE INVENTION

The present invention and the various features and advantageous details thereof are explained more fully with reference to the non-limiting embodiments described in detail in the following description.

Specific embodiments of the present invention will now be further described by the following non-limiting examples which will serve to illustrate various features of significance. The examples are intended merely to facilitate an understanding of ways in which the present invention may be practiced and to further enable those of skill in the art to practice the present invention. Accordingly, the below examples should not be construed as limiting the scope of the present invention.

Figure 13:
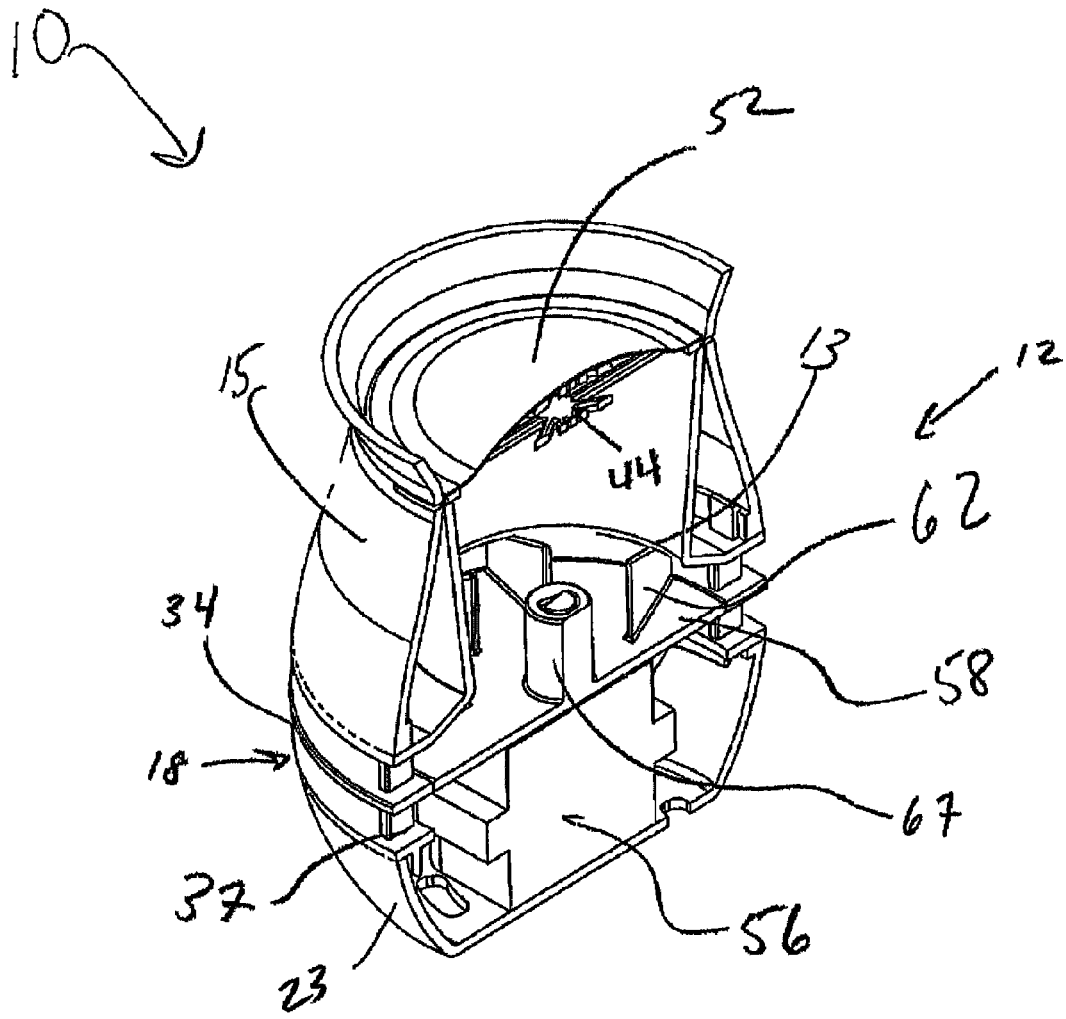
FIG. 13 is an isometric cross section of the dust and prevention removal device of the present invention.

Turning to FIG. 1, the dust prevention and removal device 10 of the present invention includes a housing 12 defining an interior space 13 (See FIG. 13) and having a top portion 14 and a bottom portion 16 circumferentially separated from one another by an outlet grill 18 configured to allow the expulsion of cleaned air from the interior of housing 12. In one embodiment the device 10 has an outside diameter that is preferably 10.795+/−0.025 centimeters (cm.) (4.25+/−0.010 inches (in.)), an overall height of 13.335 cm.+/−0.025 cm. (5.25+/−0.010 in.), and comprises a vase-like shape.

Housing 12 is preferably constructed from plastic or other such material having similar durability. The device 10 is preferably constructed of a UL listed or equivalent polymeric material, such as Polypropylene, PBT or ABS, so that the reflected thermal index (RTI) rating is not exceeded for normal use or misuse. Top portion 14 includes a circumferential side wall 15 configured to retain the inner components of device 10 therein and defining a substantially hollow structure. Likewise, bottom portion 16 comprises a circumferential side wall 23 surrounding the internal components of device 10 and a substantially solid bottom 25 for supporting device 10 on a surface.

Referring now to FIGS. 2-7, top portion 14 is releasably secured to outlet grill 18. Preferably, top portion 14 includes a number of receivers 20 on a bottom surface 21 thereof. Receivers 20 are configured to mate with a number of corresponding upwardly extending tabs 22 disposed on an upper surface 24 of outlet grill 18 (See FIG. 3). Similarly, a bottom surface 26 of grill 18 preferably includes a number of similar such receivers 28 for receiving tabs 30 disposed on an upper surface 32 of bottom portion 16. Likewise, receivers 28 are configured to matingly receive tabs 30 to secure the bottom portion 16 to the outlet grill 18. Thus, the housing 12 comprises a selectively-separable structure such that the housing may be disassembled to allow for cleaning or other maintenance. Further, the housing of the device 10 of the present invention may further include any other similar such system configured to secure the top portion 14 and bottom portion 16 to outlet grill 18.

Outlet grill 18 generally comprises a series of horizontal rungs 34 circumferentially disposed around the outside of housing 12 and defining apertures 35 for airflow therebetween. Rungs 34 are generally supported by a series of spaced struts 37. Struts 37 are preferably configured to minimize the noise and frequency matching with respect to the fan 58 of the present invention. Rungs 34 are positioned such that an operator's or child's fingers are incapable of fitting through into the interior of the housing 12 to touch the fan 58 or electronic components disposed within the device 10 in compliance with UL standards, and specifically, UL 507. Further, grill 18 generally comprises a downwardly facing opening 36 in communication with the interior of housing 12. Grill 18 further includes a projection 38 extending upwardly from upper surface 24 that generally defines a cylindrical shaft 40 having an opening 42 at an upper end thereof.

Figure 7:
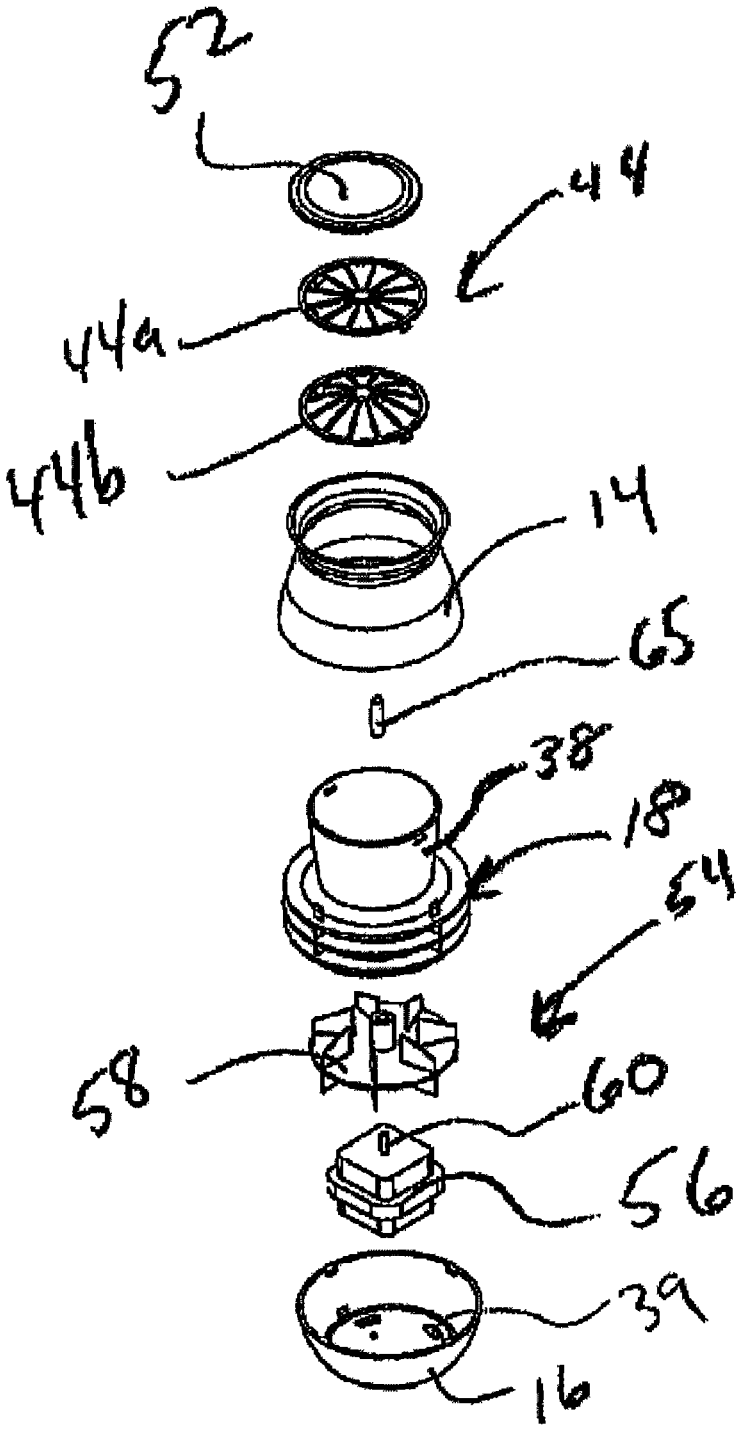
FIG. 7 is a reduced-sized exploded isometric view of the dust prevention and removal device of the present invention.
Figure 8:
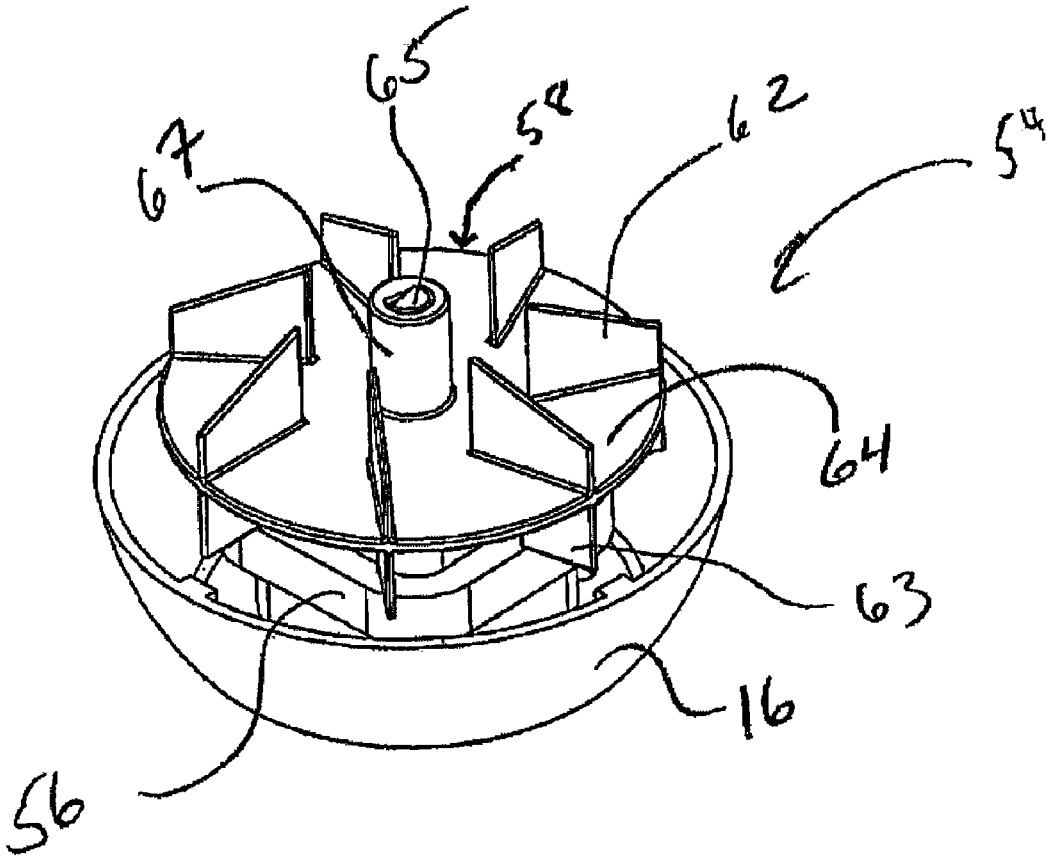
FIG. 8 is an isometric view of a motor and fan assembly secured in the bottom portion of the housing of the dust prevention and removal device of the present invention.
Figure 9:
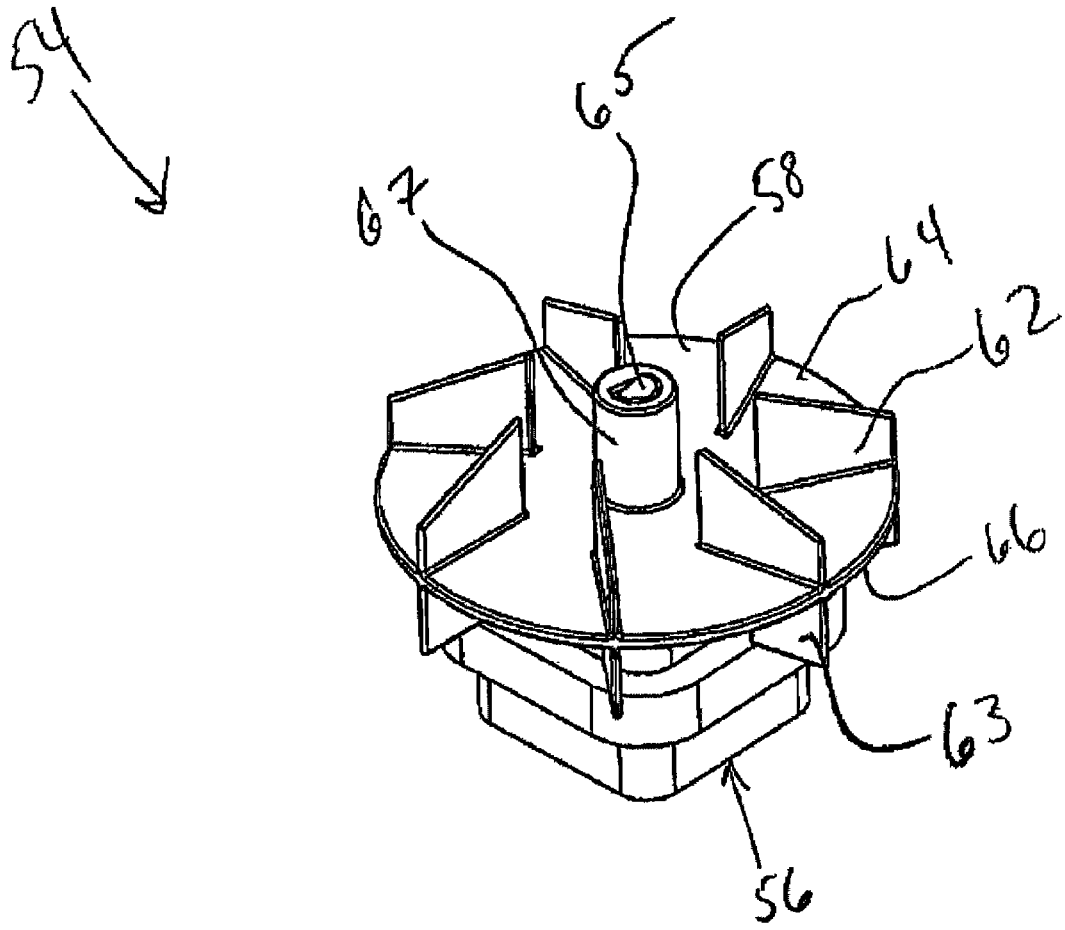
FIG. 9 is an isometric view of the motor and fan assembly of the dust prevention and removal device of the present invention.
Figure 10:
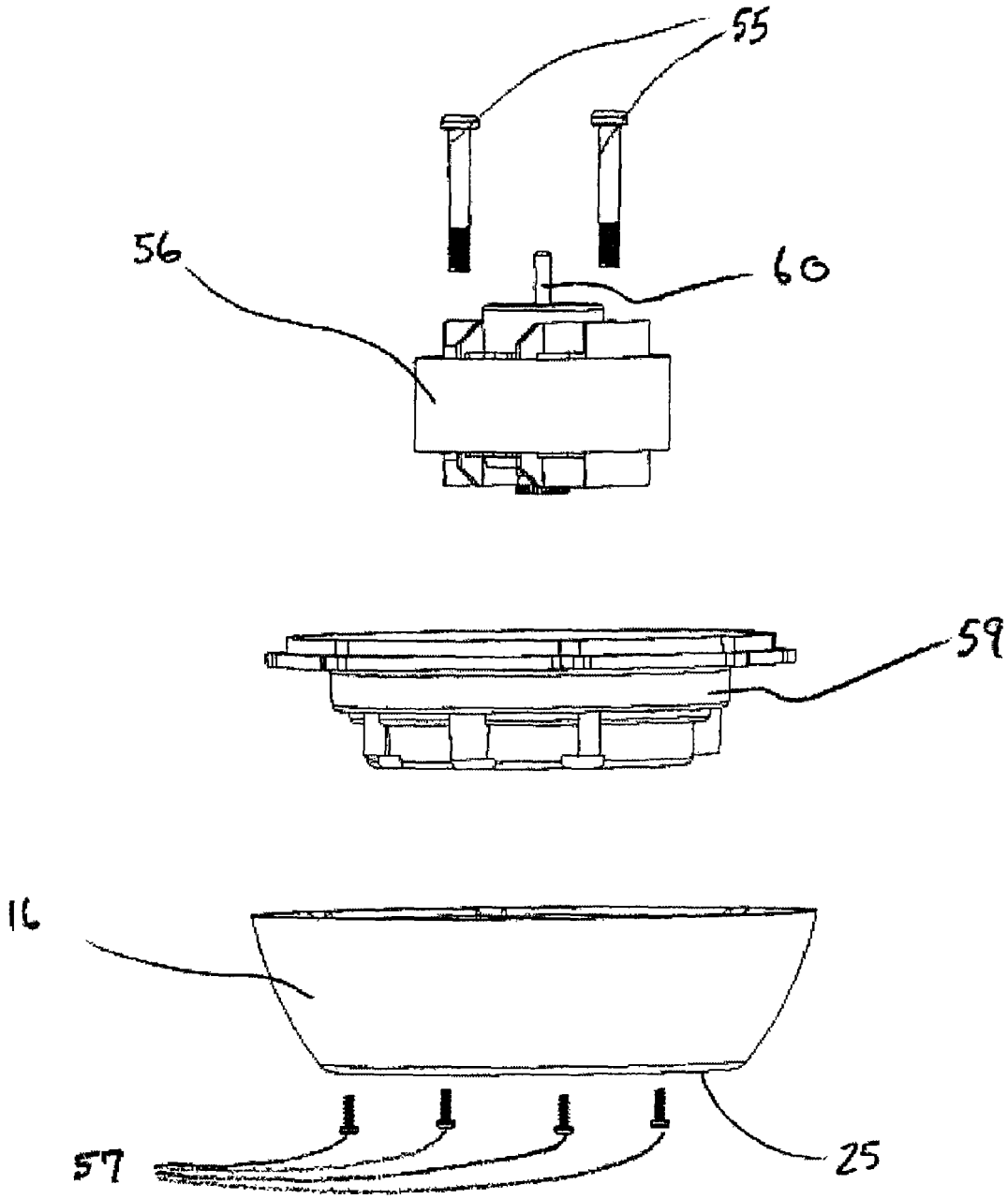
FIG. 10 is an exploded isometric view of an alternative embodiment of motor and motor mounting assembly of the dust prevention and removal device of the present invention.
Figure 11:
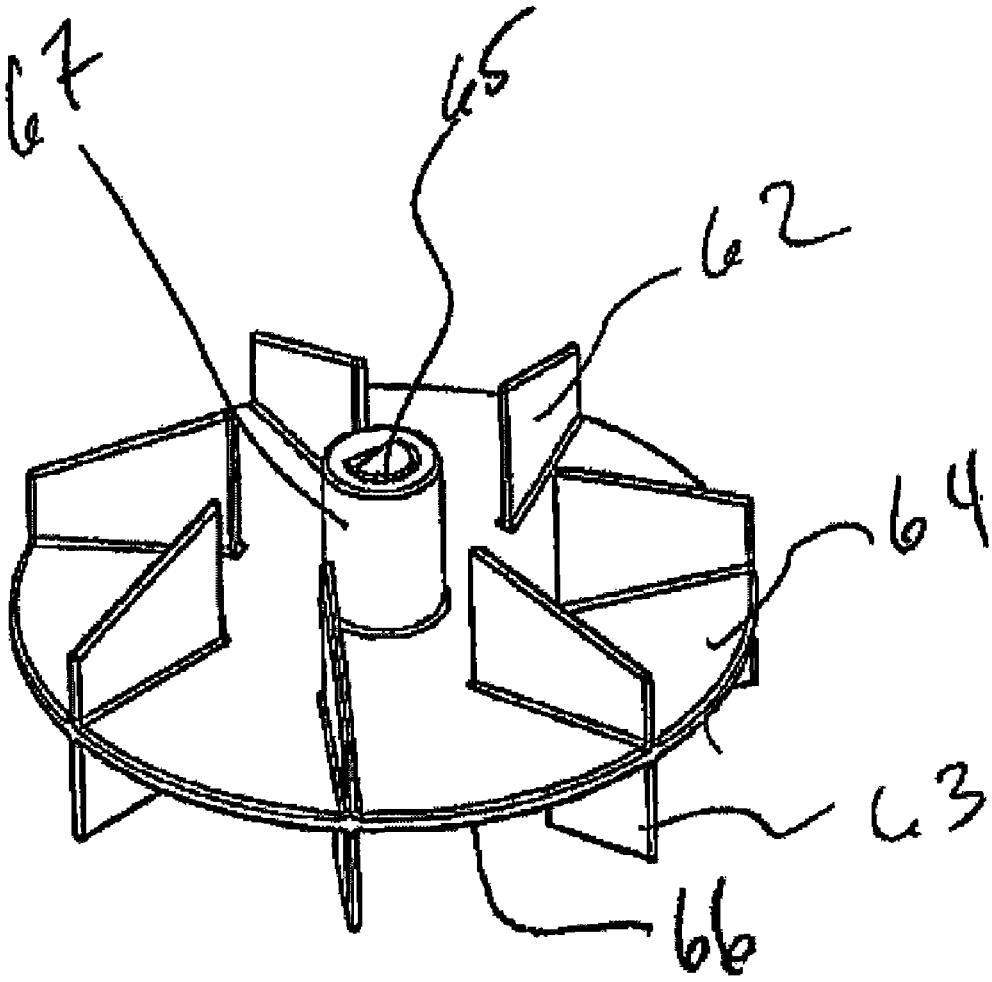
FIG. 11 is an isometric view of a fan of the dust prevention and removal device of the present invention.
Figure 12:
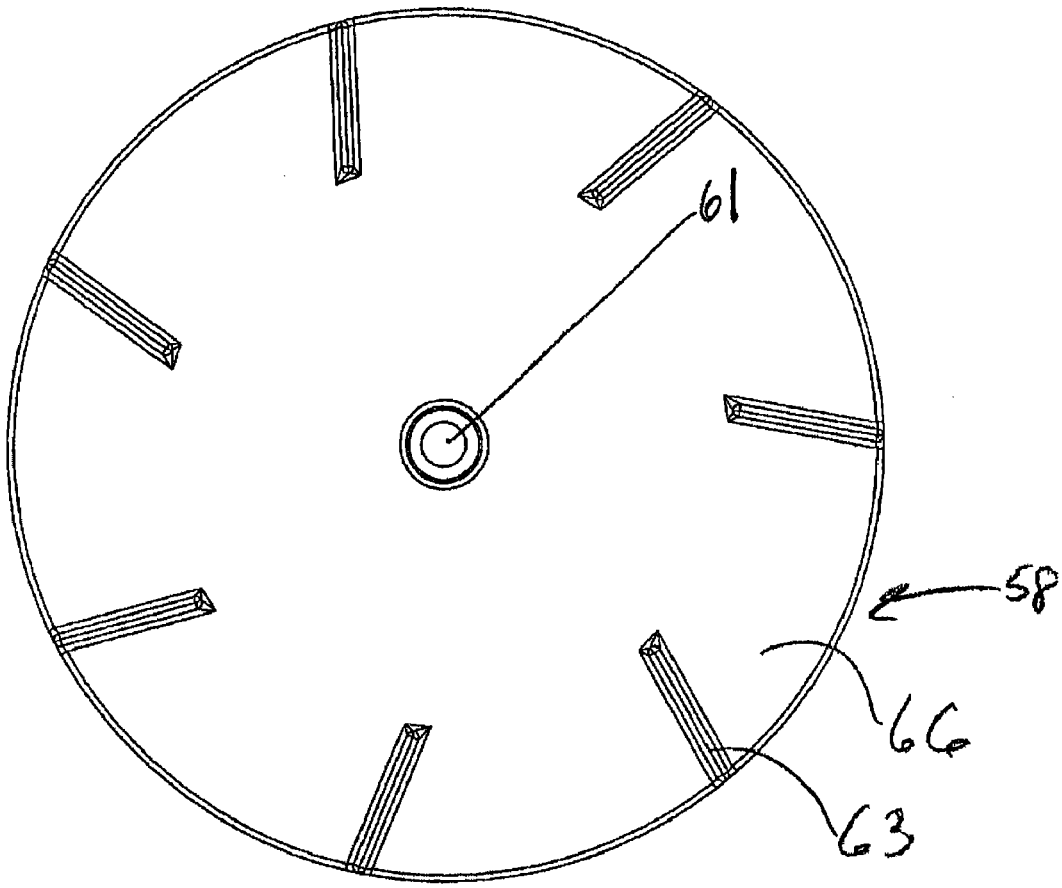
FIG. 12 is a top plan view of a bottom of the fan of the dust prevention and removal device of the present invention.

Opening 42 is generally configured to receive and secure an inlet grill 44 therein. Preferably, projection 38 includes a series of receivers 46 for receiving tabs 48 of inlet grill 44. Accordingly, receivers 46 are adapted to matingly receive tabs 48 of inlet grill 44 to secure the inlet grill and outlet grill 18 to one another. Inlet grill 44 generally includes a series of radially extending rungs 50 disposed thereon. Radially extending rungs 50 are positioned such that a user is incapable of inserting his or her fingers into the interior of housing 12. Inlet grill 44 preferably has a prime number of struts. The struts preferably have a thickness and are separated from one another by a distance that is in compliance with the UL finger probe standards, specifically, UL 507. Inlet grill 44 preferably comprises a pair of grills 44*a*, 44*b* configured to be secured to one another as shown in FIG. 7.

Inlet grill 44 is generally configured to support and secure a filter element 52 on an upper surface thereof. Alternatively, inlet grill 44 may be replaced or adapted to work in conjunction with a filter frame (not shown) of the kind known in the art. Filter element 52 can be formed of any suitable material capable of removing dust and other allergens from airflow passing therethrough. Preferably, the filter element 52 comprises a thermoformed nonwoven element. For example, the filter element 52 may comprise a thermoformed filter or the like. The thermoforming of the filter 52 allows for the filter 52 to be shaped in a concave or dome-like shape to allow for increased filter efficiency. Alternatively, the filter may be substantially flat. The filter 52 should also preferably comprise a dust holding capacity of about 600 mg. More preferably, the filter 52 should have a dust holding capacity of about 700 mg and a surface area of approximately 45 square centimeters (7 in.$^2$). The filter element 52 may also comprise a sticky nonwoven filter element, electrostatic filter element or HEPA filter element. Once the filter element 52 becomes clogged with dust and other particles, the filter element 52 may be removed from the housing 12 and replaced with a clean filter element 52.

In one embodiment of the present invention, the filter element 52 may comprise a three-dimensional formed filter that is supported by a relatively stiff frame (not shown). The frame may be constructed of, for example, paperboard or a material having similar such characteristics. The filter element 52 of this embodiment generally comprises a cone or dome-shape, wherein the shape is created by the cutting of the filter element 52 rather than forming thereof. In the present embodiment, the filter element 52 is sold as a substantially planar unit that is then assembled into the appropriate configuration by the end user thereof.

Alternatively, in another embodiment of the present invention, the filter element 52 may comprise a folding fan shape. In this embodiment, the filter element 52 comprises a substantially pleated surface that is capable of collapsing and unfolding like a folding fan. The filter element 52 of this embodiment may further include a frame which may serve as a handle when the filter element is in its collapsed position. The filter element 52 may comprise a block-type pleated filter similar to the HEPA filters often used in vacuum cleaners and the like.

In a preferred embodiment of the device 10, filter element 52 further includes a lock and key system (not shown) either disposed on the filter element 52 itself or, alternatively, on a filter frame thereof. In one preferred embodiment of the present invention, the filter frame (not shown) of filter element 52 or similar support structure includes a projection (not shown) configured to activate a switch within the device 10 of the present invention. Preferably, the projection comprises an injection molded plastic part disposed on the filter frame. Alternatively, the filter element 52 may itself include a button or thumbtack (not shown) disposed on a surface thereof for engaging the switch within device 10. In operation, device 10 will not operate unless it is fitted with a filter element 52 compatible therewith. The present embodiment of the invention ensures that customers utilize filters designed for use with device 10 thereby ensuring consumer safety.

In yet another preferred embodiment of the present invention, the filter element 52 may include a metal strip (not shown) disposed on a surface thereof. The metal strip is generally adapted to complete a circuit of device 10. A relay or similar system is activated upon completion of the circuit and thereby permits operation of the device 10. As in the prior embodiment of the filter element 52, the metal strip serves to prevent use of unauthorized or incompatible filter designs thereby ensuring proper operation.

In another preferred embodiment, the filter element 52 may include an embossing or other such finish thereon incorporating a logo or other source-identifying information incorporating a series of holes or receivers configured to interact with and receive corresponding projections disposed within the device 10. Any other suitable "lock and key" device for the filter element 52 may be utilized in practicing the present invention. The filter element 52 of the present invention preferably comprises a pleated surface. Pleated surfaces serve to substantially increase the effective surface area of the filter element 52 thereby allowing for the trapping of more dust and particulate matter.

Filter element 52 may further include a deodorizer or other such chemical impregnated thereon such that air passing through the filter element 52 is treated with the impregnated substance such that the air expelled through the outlet grill 18 comprises a pleasant or otherwise neutral smell.

Further, the filter element 52 may include a sticky or tacky substance impregnated thereon. Such substances serve to increase the overall effectiveness of the filter element 52. Any sticky or tacky substance known in the art may be utilized in practicing the present invention.

In operation, the filter element 52 preferably has effectiveness similar to that of a MERV 7 filter. Specifically, the filter element 52 is preferably about 60-68.3% efficient in mechanically trapping and retaining particulate matter that is 3 micrometers and larger when the filter is substantially clean. Efficiency of the filter increases as the filter becomes loaded with particulate matter. More preferably, the filter element 52 of the present invention has a greater than 60% efficiency in trapping and retaining particulate matter 3 micrometers and larger when clean. Further, the device 10 of the present invention preferably provides a pressure drop across the filter in the range of 0.5-1.0 cm. (0.198-0.400 in.) $H_2O$ for a clean filter. Filter 52 is configured such that exposure to humidity, sunlight, or heat below 65 degrees Celsius (150 degrees Fahrenheit) does not impact material performance.

The filter element 52 may further be adapted to operate in communication with the device 10 of the present invention such that the performance of the filter element 52 is monitored. Accordingly, the device 10 may further include a filter replacement indicator disposed on a surface thereon. Any number of acceptable filter replacement indicator systems may be utilized in practicing the present invention.

Referring now to FIGS. 7-12, the interior components of device 10 include a motor and fan assembly 54 comprising a motor 56 and a double-sided radial fan 58. Motor 56 is preferably coupled to bottom portion 16 of the housing 12. In one embodiment the motor 56 is coupled with screws or a similar such fastener to the bottom portion 16. In another preferred embodiment the motor 56 is coupled to a chassis plate 59 with screws 55 or a similar such fastener which is coupled to the bottom portion 16 with screws 57 or a similar such fastener (See FIG. 10). Bottom portion 16 preferably includes a series of receivers 39 configured to secure the motor 56 thereto. In one preferred embodiment the motor assembly 54 is substantially a twist-lock and/or snap-fit assembly with fasteners securing the motor 56 to the bottom 25. In one embodiment the bottom portion 16 has a minimum of three feet (not shown) mechanically affixed to bottom portion 16 by an adhesive or other such means for supporting device 10 on a surface. The feet are constructed of a rubber or similar such material and are adapted to offer noise dampening between the device 10 and the supporting surface. Motor 56 may be powered by way of batteries or preferably through a power source such as a standard wall outlet. Motor 56 is preferably an AC motor in communication with fan 58 by way of a shaft 60 configured to drive the rotation of the fan 58. Shaft 60 is received through a hole 61 running through the center of fan 58. Shaft 60 is preferably received by a D-shaped motor shaft adapter 65. The use of a D-shaped motor shaft adapter 65 prevents the shaft 60 from spinning within the fan hub 67. As such, the efficiency of motor 56 is maximized by reducing the amount of ineffective energy transfer. Preferably, the displacement vibration of the shaft is 0.05 millimeters (mm.) per second (0.002 in. per second) or less with a displacement vibration of the housing with fan at full speed of 2 mm. per second (0.079 in. per second) or less along all axes, and the shaft end play (i.e. up/down rotor movement) is preferably no more than +/−0.280 cm. (+/−0.11 in.). Preferably, the motor 56 is a 20 Watt 120 VAC 60 Hz shaded pole motor or similar such AC single phase induction motor of the kind known in the art. More preferably, the motor 56 is 16 Watt or less. Preferably, the motor 56 has a rated voltage of 120+/−12 VAC, with a rated current of 20 mA or less, with a startup voltage of 90 VAC, and can withstand a high-pot voltage of 1240 VAC for 1 second. The motor 56 preferably has an operating temperature range of 0 to 110 degrees Celsius (32 to 230 degrees Fahrenheit) and a TCO rating of 125 degrees Celsius (257 degrees Fahrenheit). Motor 56 preferably has a life expectancy of at least 20000 hours with continuous operation, a motor efficiency of approximately 20%, with a rated output power at the shaft 60 of 4 Watts, and a bearing system capable of handling off-axis forces and moments created by slightly warped fan blades. Preferably, the motor height is 4.125+/−0.25 cm. (1.65+/−0.010 in.). Preferably, the motor 56 is capable of driving the fan 58 between about 2000 and 3000 revolutions per minute (RPM). More preferably, the motor 56 operates between 2200 and 2800+/−100 RPM. More preferably still, the motor 56 is capable of driving the fan at about 2700 RPM. Preferably, motor 56 is capable of moving greater than 12 cfm of air at 120 VAC at the air inlet grill 44 when filter 52 is installed. More preferably, motor 56 is capable of moving 14 cfm of air at 2600 RPM while the filter 52 is installed. In one embodiment the motor 56 is 230 VAC 50 Hz, and in another embodiment the motor 56 is 100 VAC 50-60 Hz. Fan 58 of the present invention is preferably a double-sided radial fan having a number of blades 62 disposed on its upper surface 64 and a number of blades 63 on its lower surface 66. Fan 58 is generally adapted to draw air through inlet grill 44 and filter element 52 of device 10 and into the interior of housing 12. In operation, the blades 62 of the upper surface 64 of the fan 58 "turn" the air flowing through inlet grill 44 about 90 degrees, i.e., from a vertical airflow to a horizontal airflow, such that the filtered air can be expelled horizontally out of the outlet grill 18 of device 10. The fan hub 67 of fan 58 is preferably a relatively small stub large enough to receive shaft 60. The minimization or elimination of fan hub 67 serves to maximize airflow therethrough. Preferably, the number of blades 62 of the upper surface 64 is a prime number such as 3, 5, 7, etc. The utilization of a prime number of blades 62 serves to minimize the noise at frequencies that are multiples of the fan blades 62.

In one embodiment of the device 10 of the present invention, the device 10 includes a power cord (not shown) adapted for use with a standard wall outlet. Further, the motor 56 is preferably turned on by plugging the cord into the outlet and turned off by unplugging it such that a power switch is not necessary. The cord is preferably an 18AWG two-conductor, a minimum of six feet with a male plug, includes strain relief, and has outer jacket material that can withstand a minimum temperature of 105 degrees Celsius (221 degrees Fahrenheit). Alternatively, device 10 may include a power switch for selectively turning the device 10 on and off. In another embodiment, the device 10 is battery powered.

Figure 14:
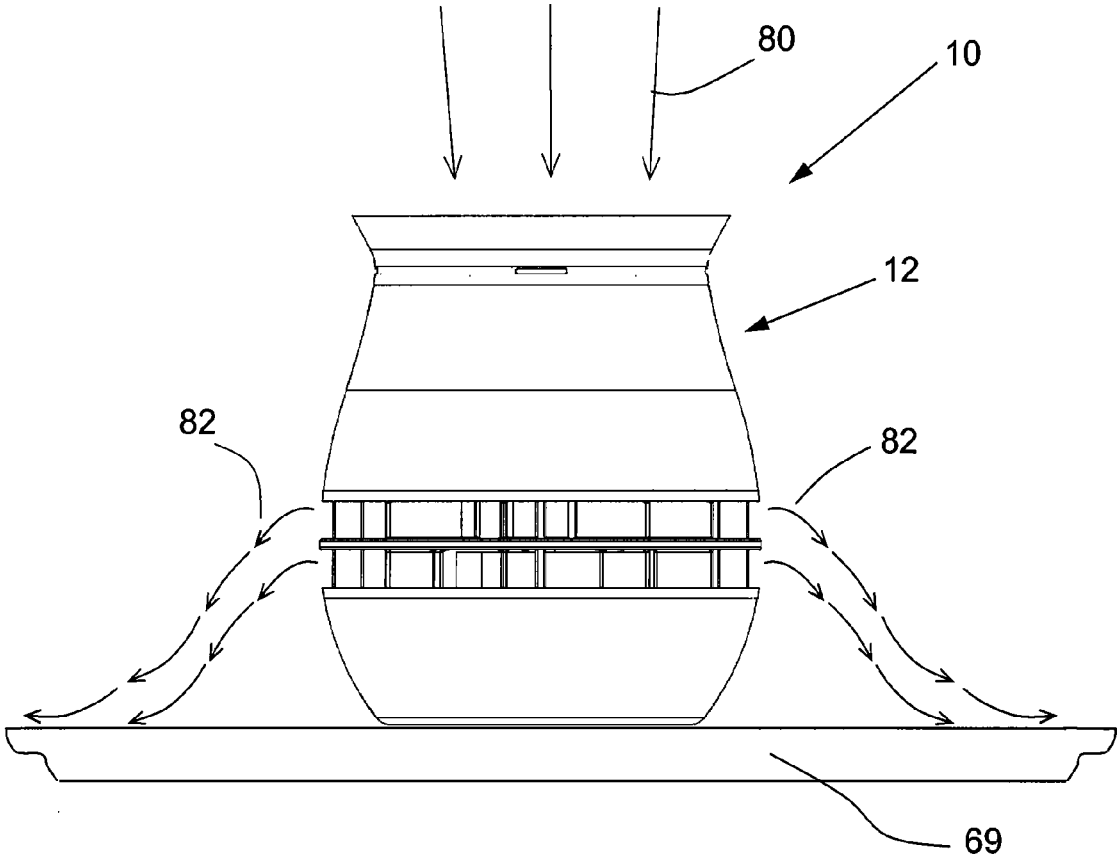
FIG. 14 is an isometric side elevation view of the dust and prevention removal device of the present invention on a table in a room.

It should be noted that the airflow created by the fan also may prevent dust and other particulates from settling on the surface where device 10 is placed upon. For example, the surface of the table 69 shown in FIG. 14 may be kept relatively dust free by running device 10 over an extended period of time. As shown in FIG. 14, airflow is drawn through the top of device 10 as shown by arrows 80 and air is expelled horizontally outwardly from the device 10 as shown by arrows 82. Accordingly, the airflow represented by arrows 82 is blown across the surface of the table 69 thereby dislodging any settled particulates and preventing the settling of any other particulates. Thus, the device 10 substantially reduces the amount of hand dusting required over a surface by continually expelling air (shown as arrows 82) over the surrounding surface such that dust is not allowed to settle thereon. Preferably, there is a visible reduction of dust settling 360 degrees around the device in a 1.23 meter radius (four ft. radius) of the center of the device Further, in operation of the device 10 of the present invention, the device 10 utilizes the Coanda effect to prevent the settling of dust and other particulate matter on surfaces near the device 10. Accordingly, as air is expelled from the device 10, the air is drawn down to adhere to a convex airfoil by a combination of the greater pressure above the air flow and the lower pressure below the flow caused by an evacuating effect of the flow itself, which as a result of shear flow, rarefies the slow-moving air trapped between the flow and the upper surface of the airfoil.

The blades 63 of lower surface 66, on the other hand, are configured to circulate air through the bottom portion 16 of the interior of housing 12 to thereby keep the motor 56 cool.

Further, the design of blades 63 serves to prevent access to the motor 56 of assembly 54 with a foreign object during operation of the device 10. Preferably, the number of blades 63 of the lower surface 66 is a prime number such as 3, 5, 7, etc. By utilizing a prime number of blades 63, the noise at frequencies that are multiples of fan blades 63 is thereby minimized.

The motor 56 and fan 58 of assembly 54 of the present invention should preferably operate at an appropriate noise level. Preferably, the noise created during operation of device 10 should be less than 50 dBA. More preferably, noise levels should not exceed 40 dBA. More preferably, noise levels should range between 30-40 dBA. In a preferred embodiment of the present invention, noise levels are less than 34 dBA in an anechoic chamber at a distance of 1 meter (39.4 in.) with a clean filter element 52 installed.

In operation, when the fan 58 is switched on and powered by motor 56, the fan 58 draws air from the exterior environment through the filter element 52 at the top of the device 10. As the air passes through the filter element 52, various dust, allergens, and other particulate matter contained within the air are removed from the air by the filter element 52. After passing through the filter element 52, the now-cleaner air is drawn through inlet grill 44 and into the interior of the device 10. The air flowing through the housing is then radially forced out through outlet grill 18 by the fan 58 which effectively rotates the vertical airflow 90 degrees to a substantially horizontal airflow. The air is expelled through the upper apertures of grill 18 around the entire circumference of device 10. In one embodiment of the present invention, a shroud (not shown) may be included to close a selected portion of the apertures of grill 18 such that air is incapable of being expelled therethrough. In one embodiment, the outlet grill 18 comprises a two-piece assembly. The two-piece outlet grill 18 preferably comprises two substantially equally-sized halves, wherein the two pieces of outlet grill 18 are adapted for secure coupling to the other of the two pieces. The two pieces of outlet grill 18 are preferably coupled to one another by way of fasteners such as screws or bolts. Preferably, each of the two pieces of outlet grill 18 include recesses at each of the respective ends thereof for receiving one end of the fastener for coupling to the other half of outlet grill 18.

Figure 15:
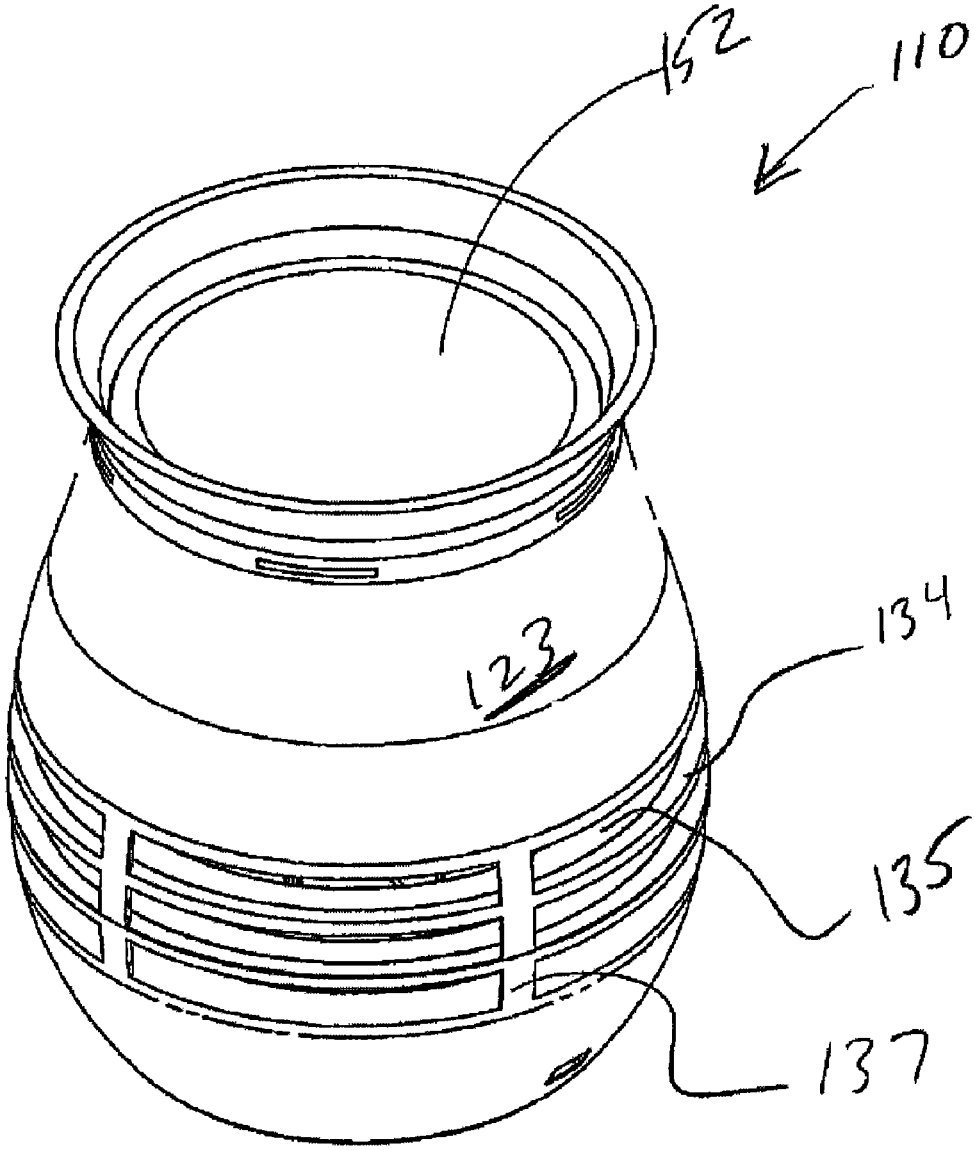
FIG. 15 is an isometric view of an alternative embodiment of the dust prevention and removal device of the present invention.
Figure 16:
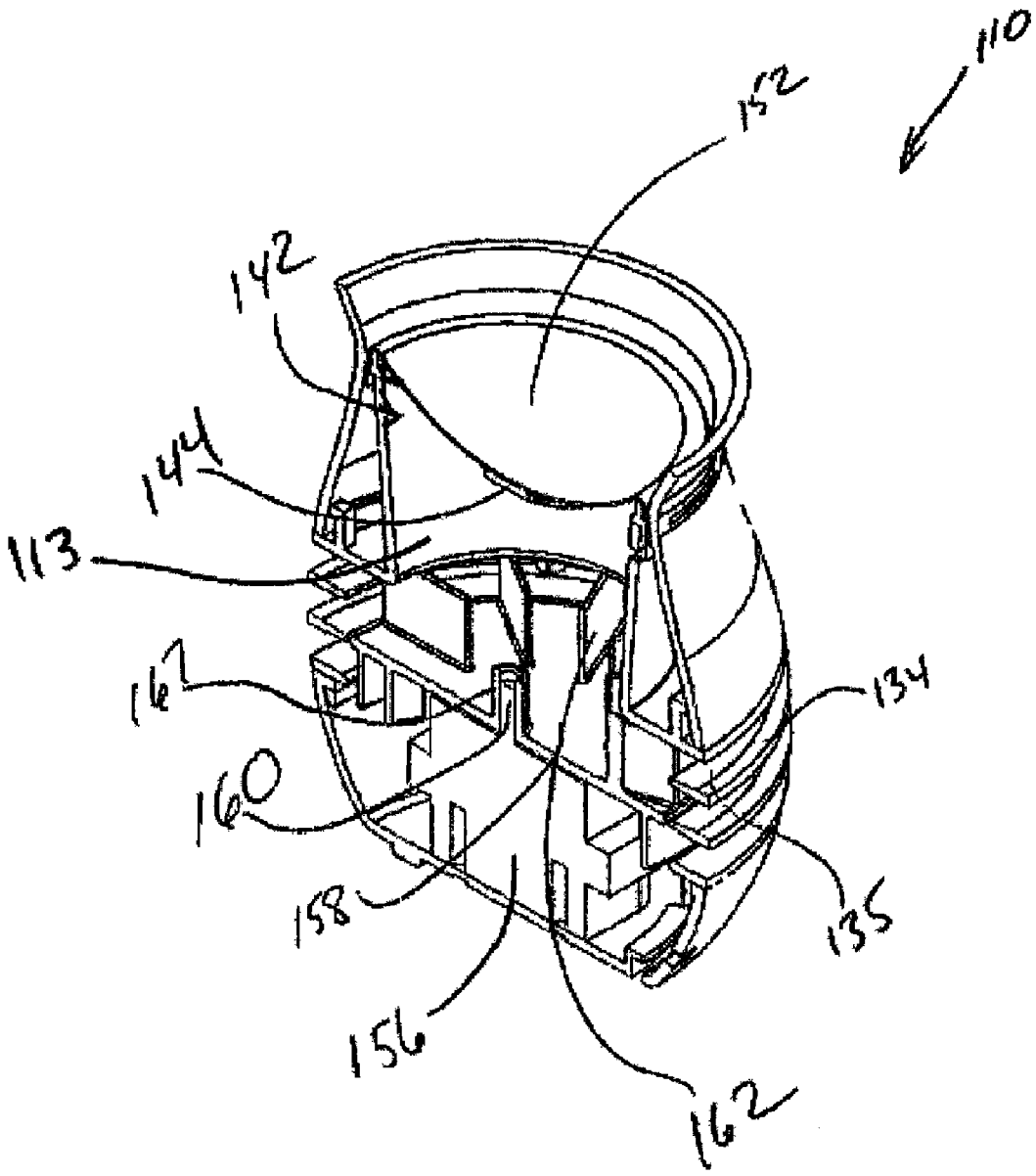
FIG. 16 is an isometric cross section view of the dust prevention and removal device of FIG. 15.

Referring now to FIGS. 15 and 16 an alternative embodiment of the device 110 of the present invention is shown. The device 110 includes a housing 112 defining an interior space 113 and including a filter 152 supported on a grill 144 over an opening 142 for drawing air from the surrounding area into the interior space 113 of the device 110. The housing 112 further includes a set of horizontally extending rungs 134 circumferentially disposed around an outer side wall 123 to define a number of apertures 135 for expelling air therefrom. Rungs 134 are preferably beveled such that the thickness is less near the fan 58 and the interior surface 133 nearest the fan 58 has a substantially rounded face, rather than flat with square edges, to reduce noise and turbulence while exterior surface 139 is preferably flat with square edges to preserve aesthetics. The rungs 134 are supported by a number of struts 137 longitudinally extending through the rungs 134. In an alternative embodiment, the struts 137 may be longitudinally staggered so as to limit the amount of noise created by the expelling of air therethrough (see FIG. 25A). Preferably, the number of struts 137 is a prime number to reduce resonant vibration of fan 58. Further, interior edges of strut 137, which face fan 58 and side edges of strut 137 preferably have a substantially curved or radial shape to reduce turbulence and noise while increasing strength. The outer face of strut 137 is substantially flat with square edges to provide an aesthetically pleasing appearance. In addition, the struts 137 are preferably located as far from the fan 58 as possible to reduce noise created by air turbulence (see FIG. 25A). In addition, staggering the struts 137 prevents localized dust pattern settling. That is, the dust blown away from the device 110 will be blown in a non-uniform pattern such that large collections of dust are not created by the air expelled out of the device 110.

The device 110 includes a motor 156 coupled to a fan 158 for drawing air in through the opening 142 and out the apertures 135 defined by rungs 134 and struts 137. The motor 156 includes an output shaft 160 received by a hub 167 in the D-shaped motor shaft adapter 165 of the fan 158.

Figure 17:
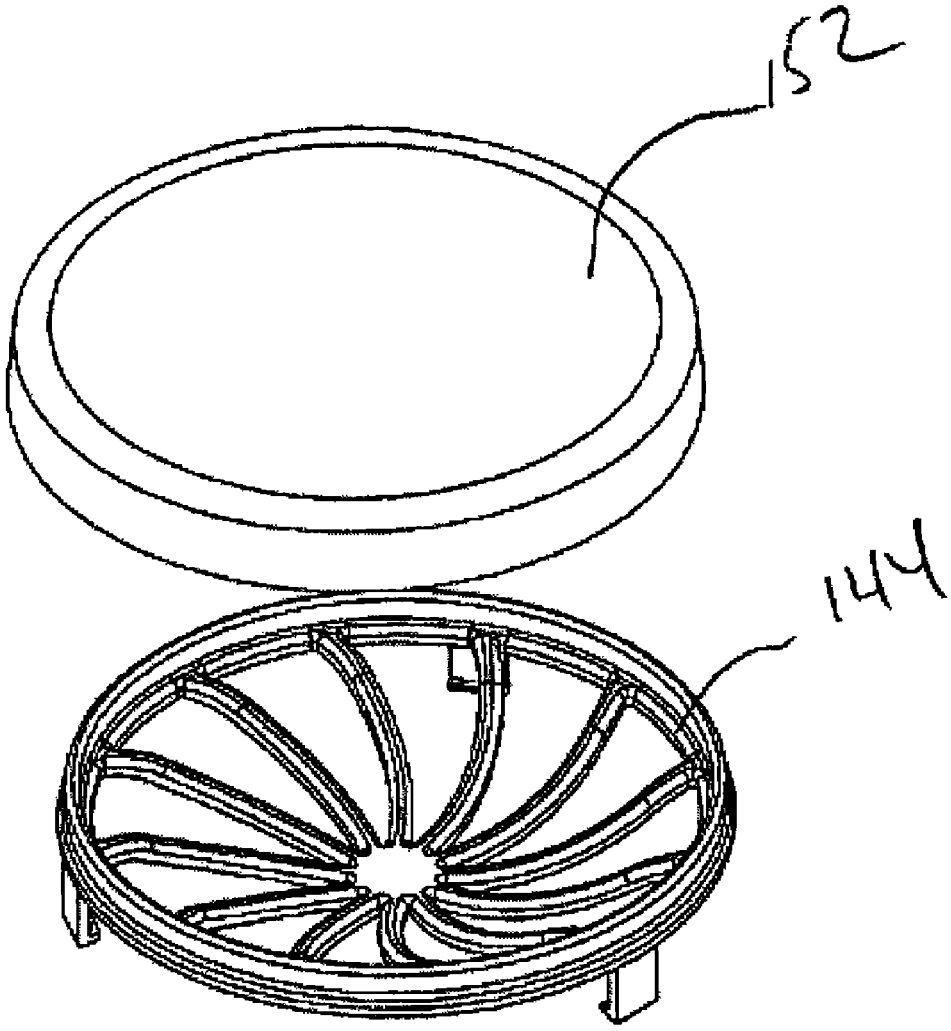
FIG. 17 is an exploded isometric view of a filter and inlet assembly of the dust prevention and removal device of FIGS. 15 and 16.

Turning now to FIG. 17, the grill 144 and filter 152 are shown. As in the previous embodiments, the filter 152 and the grill 144 may comprises a number of different shapes and sizes and may be constructed from a variety of different materials. As shown in FIG. 17, the grill 144 is shaped to communicate with the filter 152 such that only approved filters may be used with the device 110 of the present embodiment.

Figure 18:
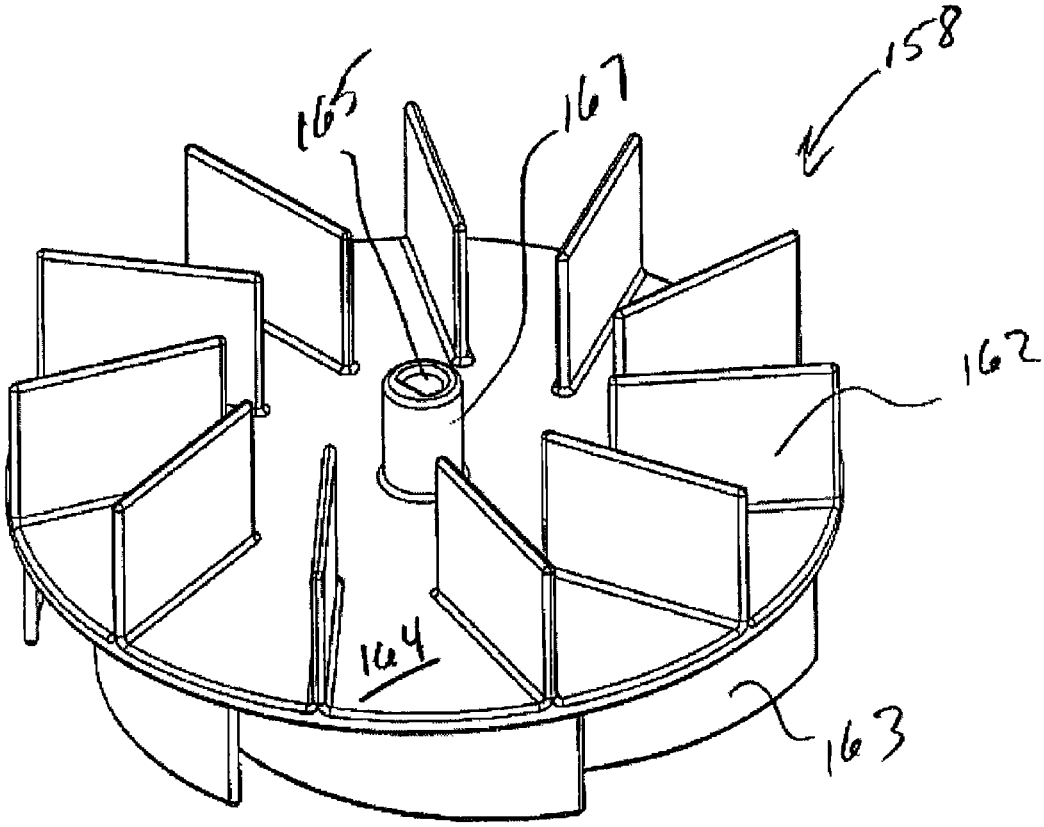
FIG. 18 is an isometric view of an alternative embodiment of the fan of the dust prevention and removal device of the present invention.
Figure 19:
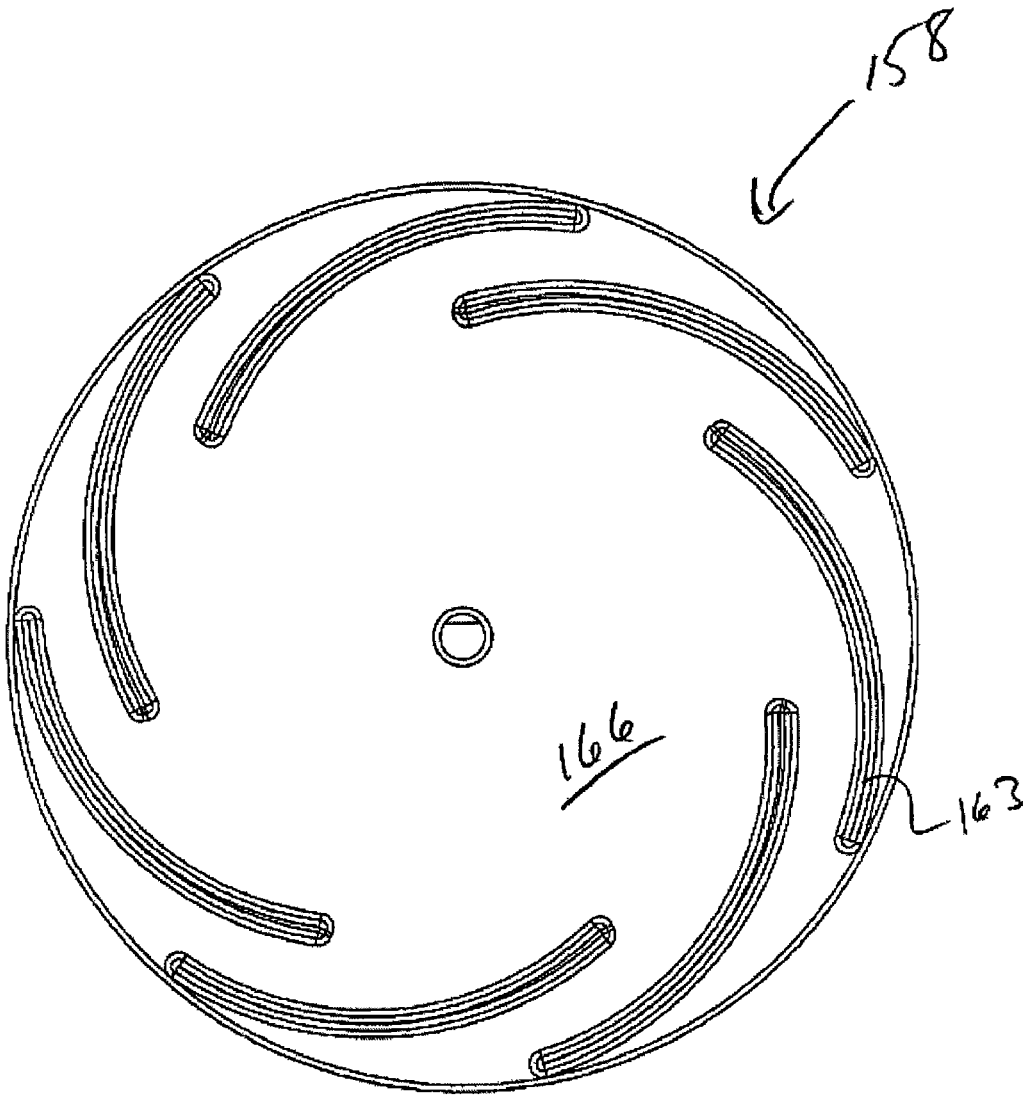
FIG. 19 is a top plan view of a bottom of the fan of FIG. 18.

Turning now to FIGS. 18 and 19, the fan 158 of this embodiment of the present invention is shown. The blades 162 on the upper surface 164 of the fan 158 are substantially similar in shape and arrangement to those of the previous embodiment. Preferably, the fan 158 includes a prime number of blades 162. More preferably, the fan 158 includes seven blades 162 on an upper surface 164 of fan 158 with a radius of 4.318+/−0.018 cm. (1.70+/−0.007 in.), blade height of 1.65+/−0.018 cm. (0.65+/−0.007 in.), blade length of 2.36+/−0.018 cm. (0.93+/−0.007 in.) and a backward sweep angle of 25+/−1 degree. In addition, the fan 158 of the current embodiment is preferably parabolically shaped. The blades 163 on the lower surface 166 of the current embodiment are preferably curved and circumferentially arranged around the perimeter of the bottom surface 166 of the fan 158 in an overlapping configuration. Accordingly, the blades 163 are configured to block a user's view of the motor 156 and prevent objects from being inserted into the fan 158 or motor 156. The curved shape of the blades 163 further provides air flow to the area surrounding the motor 156 by circulating air therethrough. As with blades 162, it is preferred that a prime number of blades 163 be provided on the bottom surface 166. More preferably, the number of blades 163 is seven. The fan 158 preferably provides airflow of 20 cfm+/−1 cfm and is comprised of V2 rated material that meets UL 507 standard for electric fans.

Figure 20:
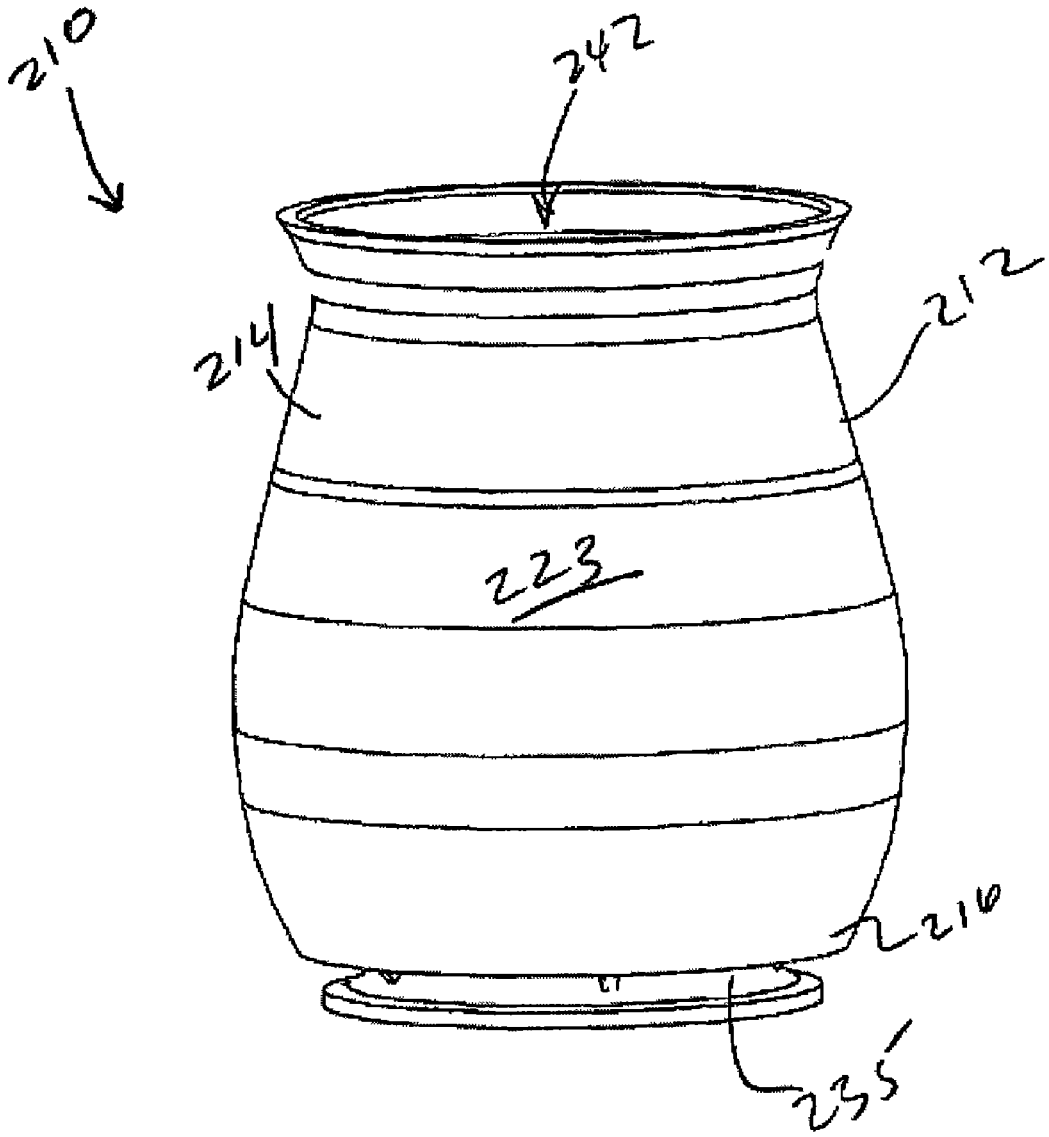
FIG. 20 is a side elevation view of an alternative embodiment of the dust prevention and removal device of the present invention.
Figure 21:
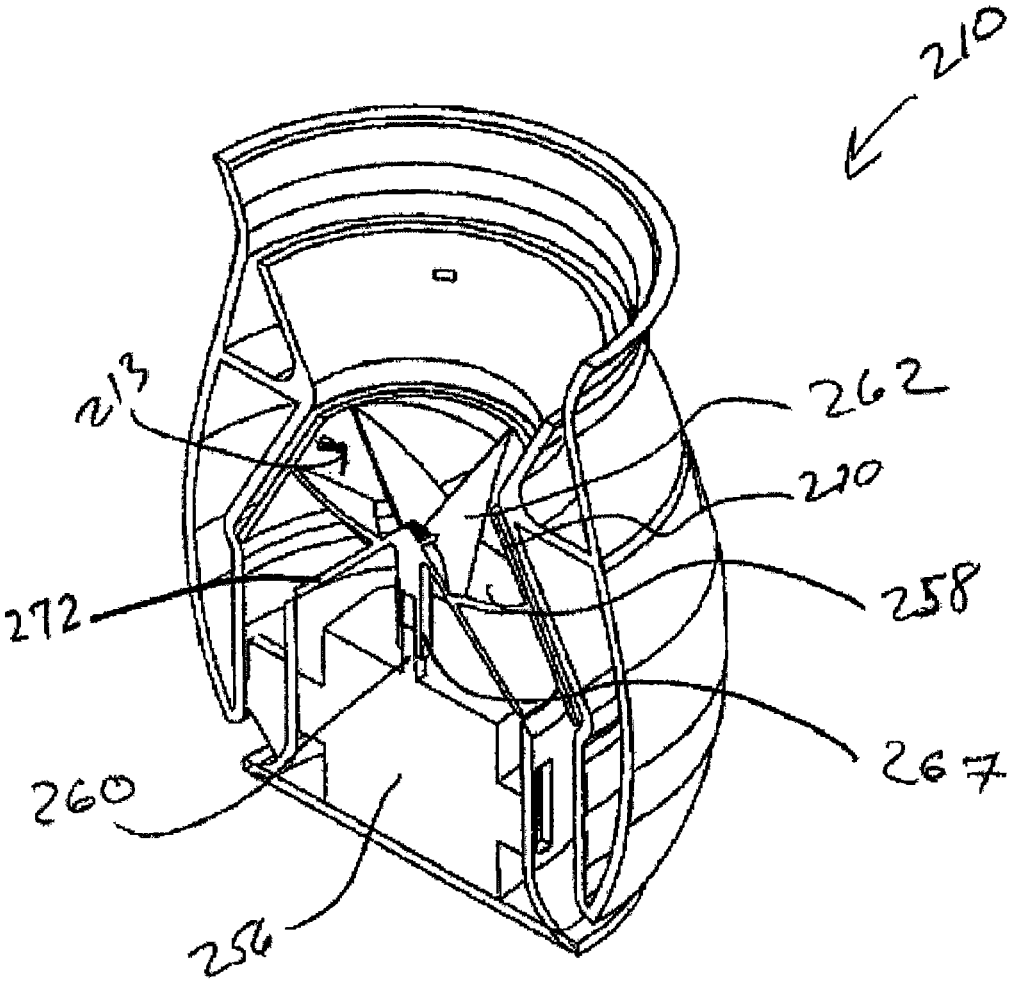
FIG. 21 is an isometric cross section of the dust prevention and removal device of FIG. 20.
Figure 22:
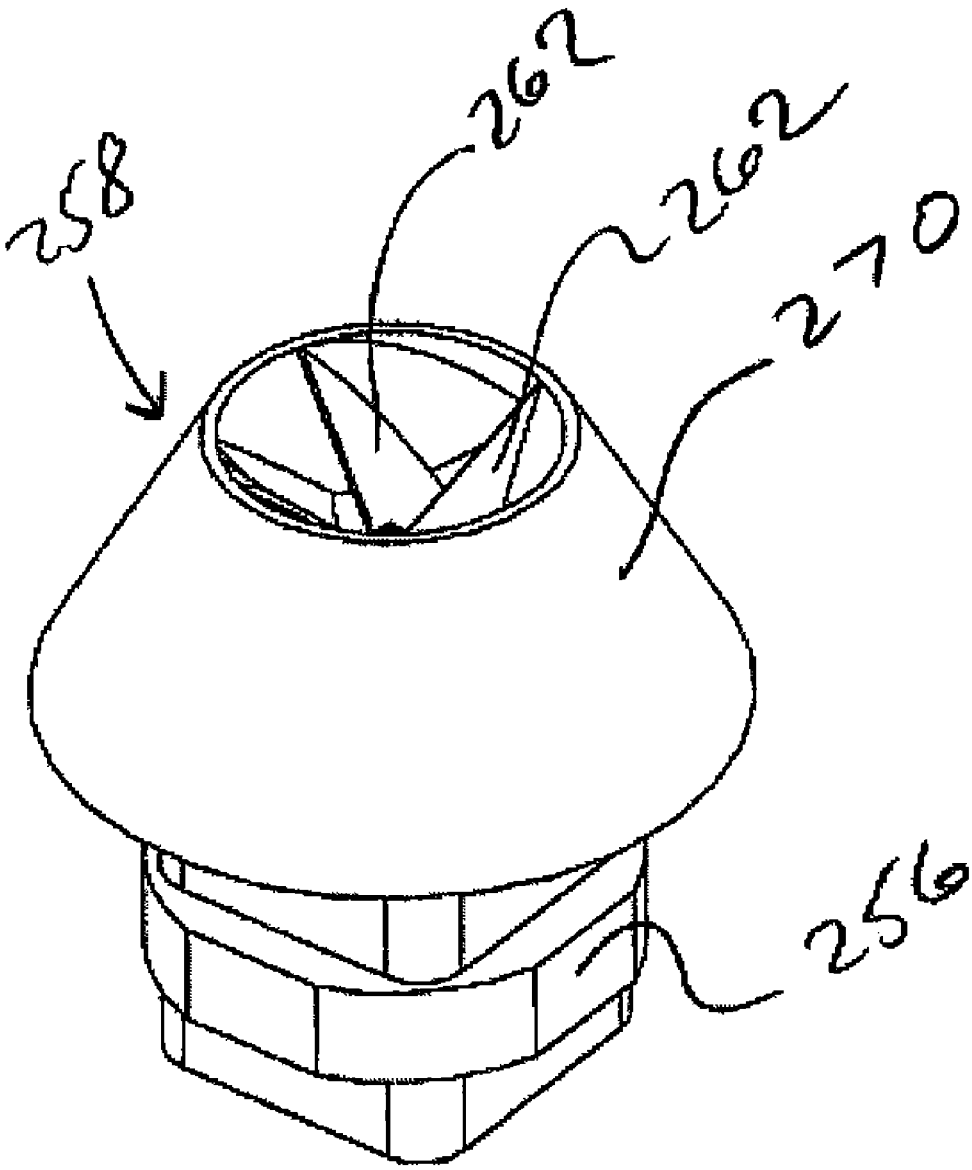
FIG. 22 is an isometric view of a fan and motor assembly of the dust prevention and removal device of FIGS. 20-21.
Figure 23:
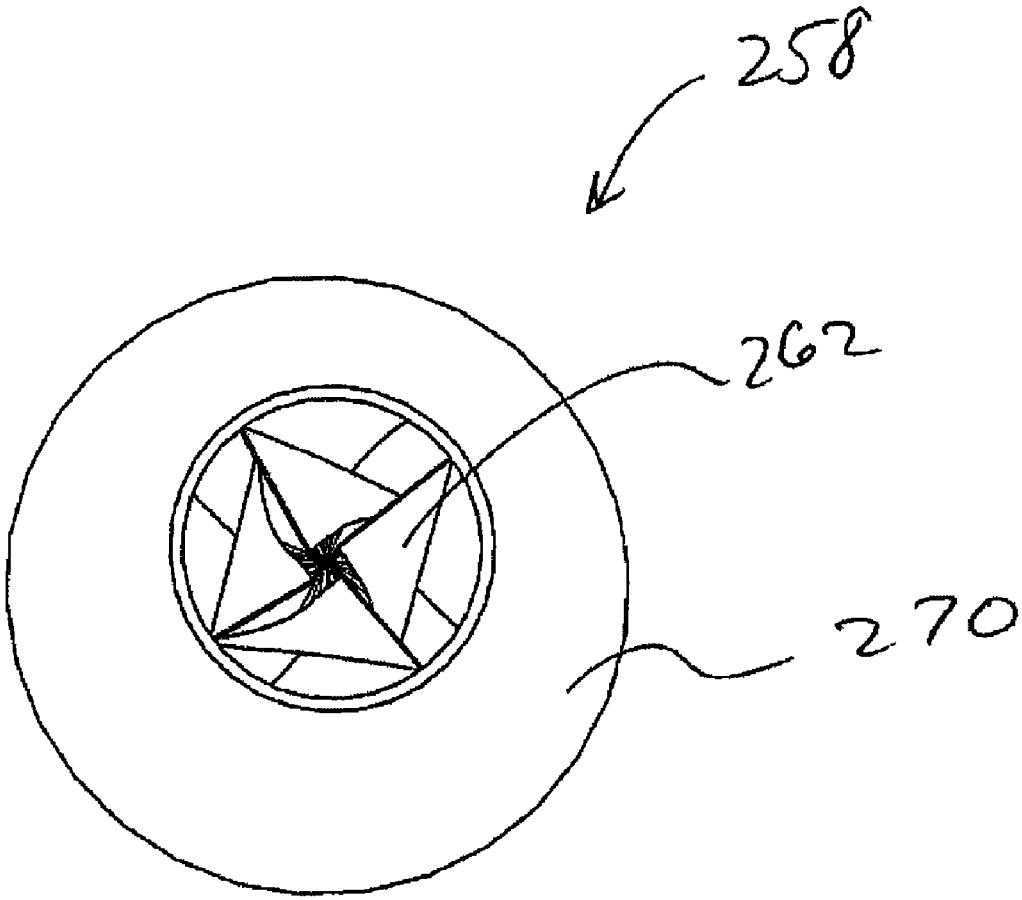
FIG. 23 is a top plan view of the fan of the dust prevention and removal device of FIGS. 20-22.
Figure 24:
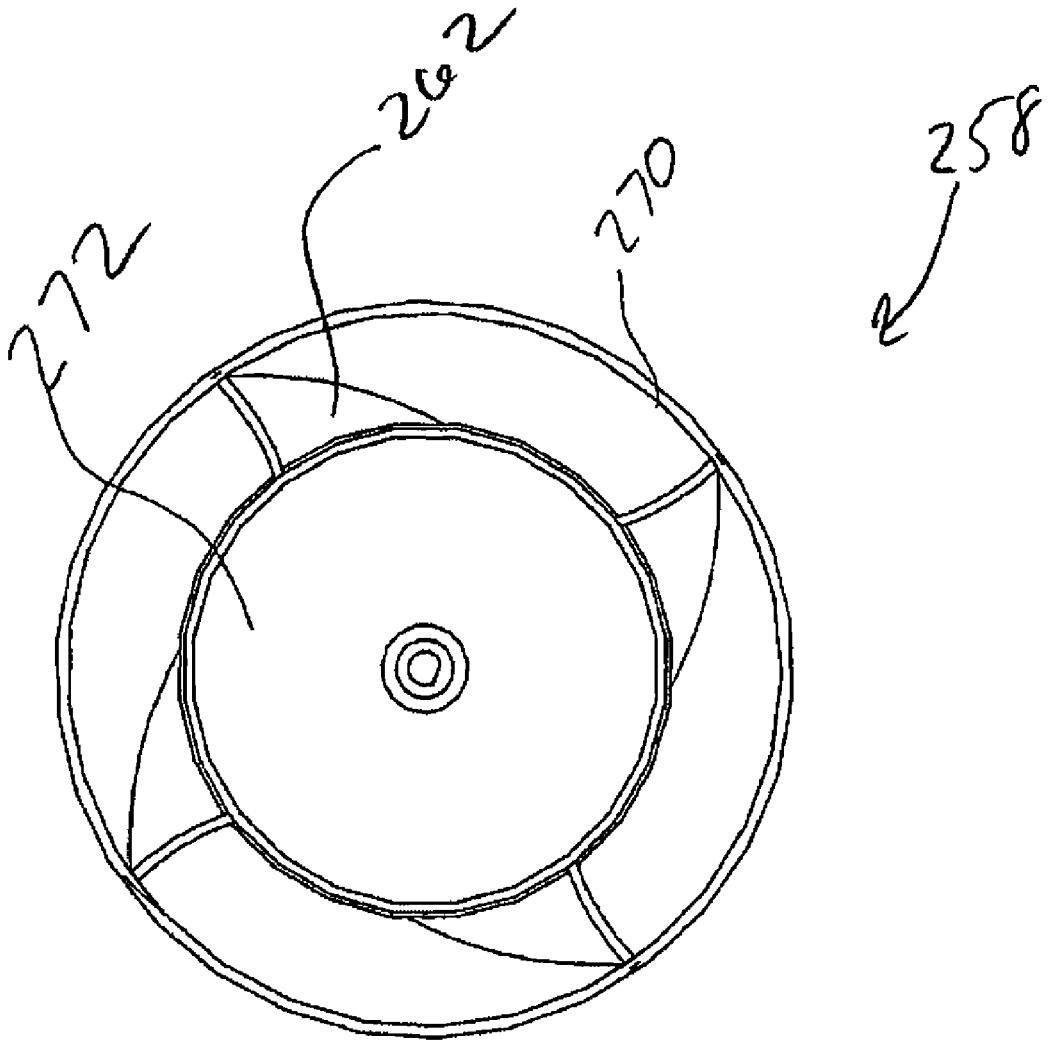
FIG. 24 is a top plan view of a bottom of the fan of the dust prevention and removal device of FIGS. 20-23.

FIGS. 20 and 21 illustrate yet another embodiment of the device 210 of the present invention. Device 210 includes a housing 212 defining an interior space 213. The housing 212 includes a circumferential sidewall 223. A top portion 214 secures a grill (not shown) and filter (not shown) and defines an opening 242 for drawing air from the surrounding area into the interior space 213 of the device 210. A bottom portion 216 includes a circumferential aperture 235 for expelling air out of the device 210.

The device 210 includes a motor 256 having an upwardly extending output shaft 260. Output shaft 260 is configured for securing the motor 256 to a hub 267 of a fan 258. The fan 258 comprises a substantially frustoconcially shaped housing 270. The housing 270 defines an interior space having a number of blades 262 secured therein. The blades 262 are disposed on a conically shaped body 272 that includes the hub 267.

Figure 25A:
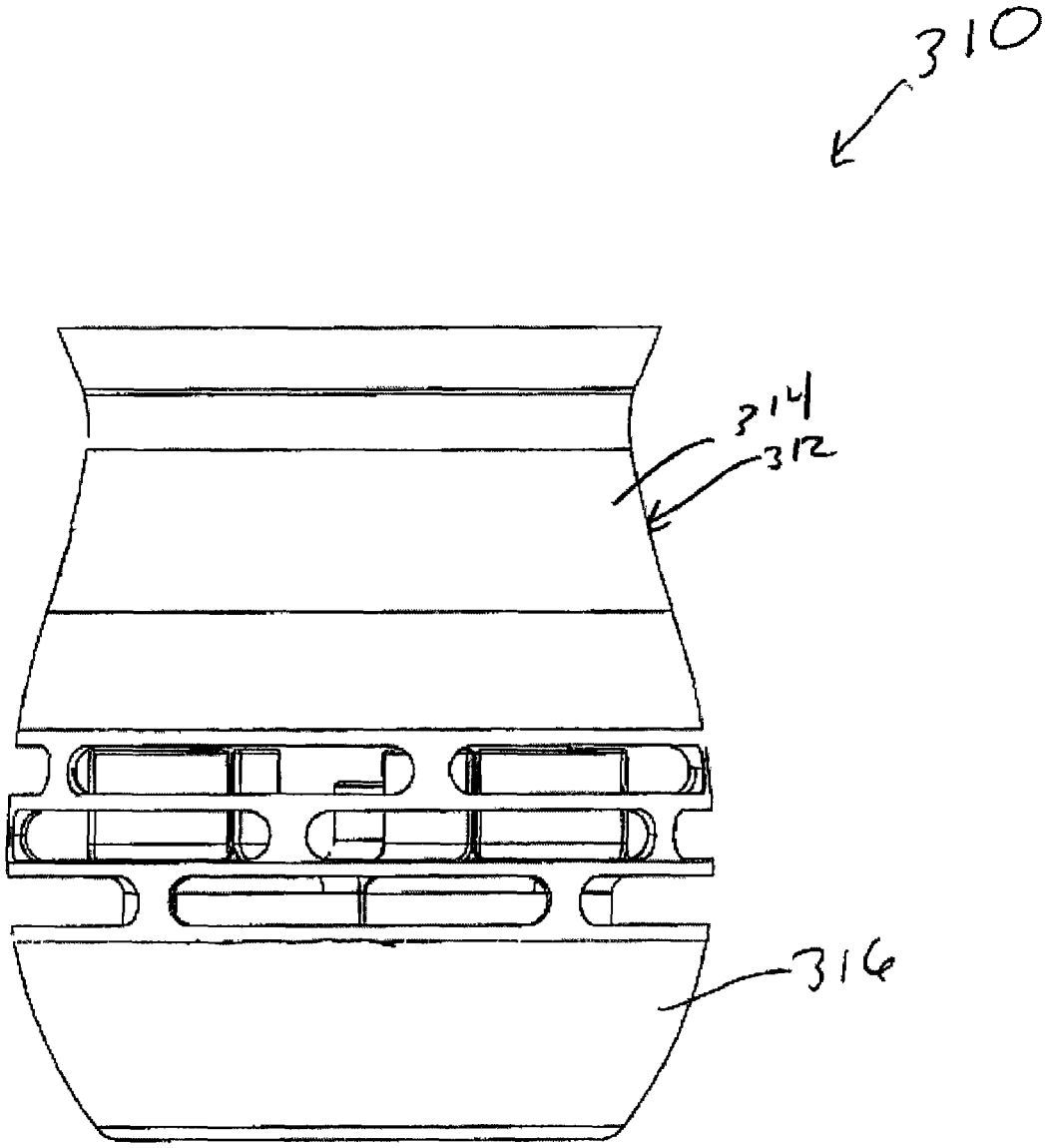
FIG. 25A is a side elevation view of a dust prevention and removal device including a lock and key assembly.
Figure 25B:
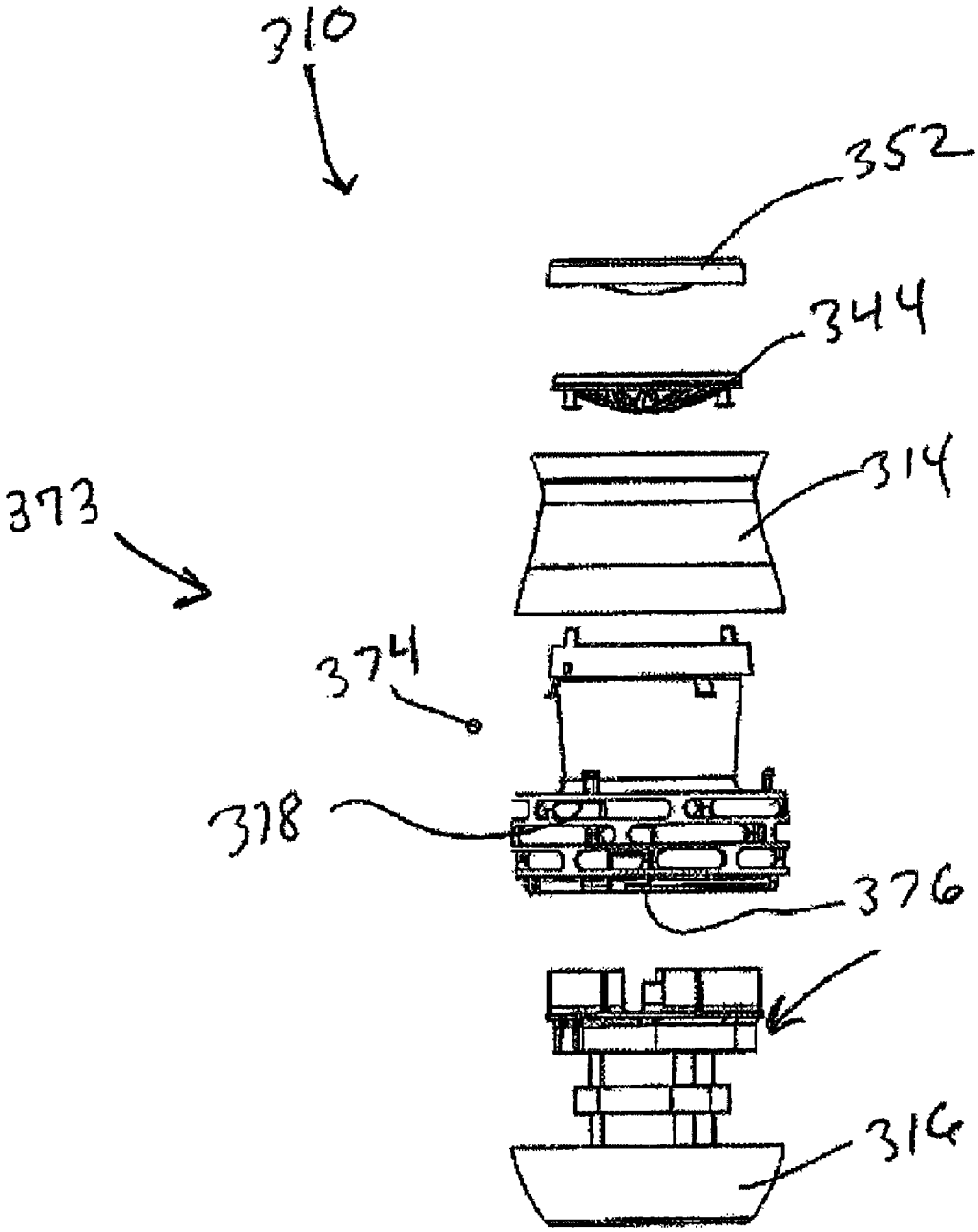
FIG. 25B is an exploded side elevation view of the dust prevention and removal device of FIG. 25A.
Figure 25C:
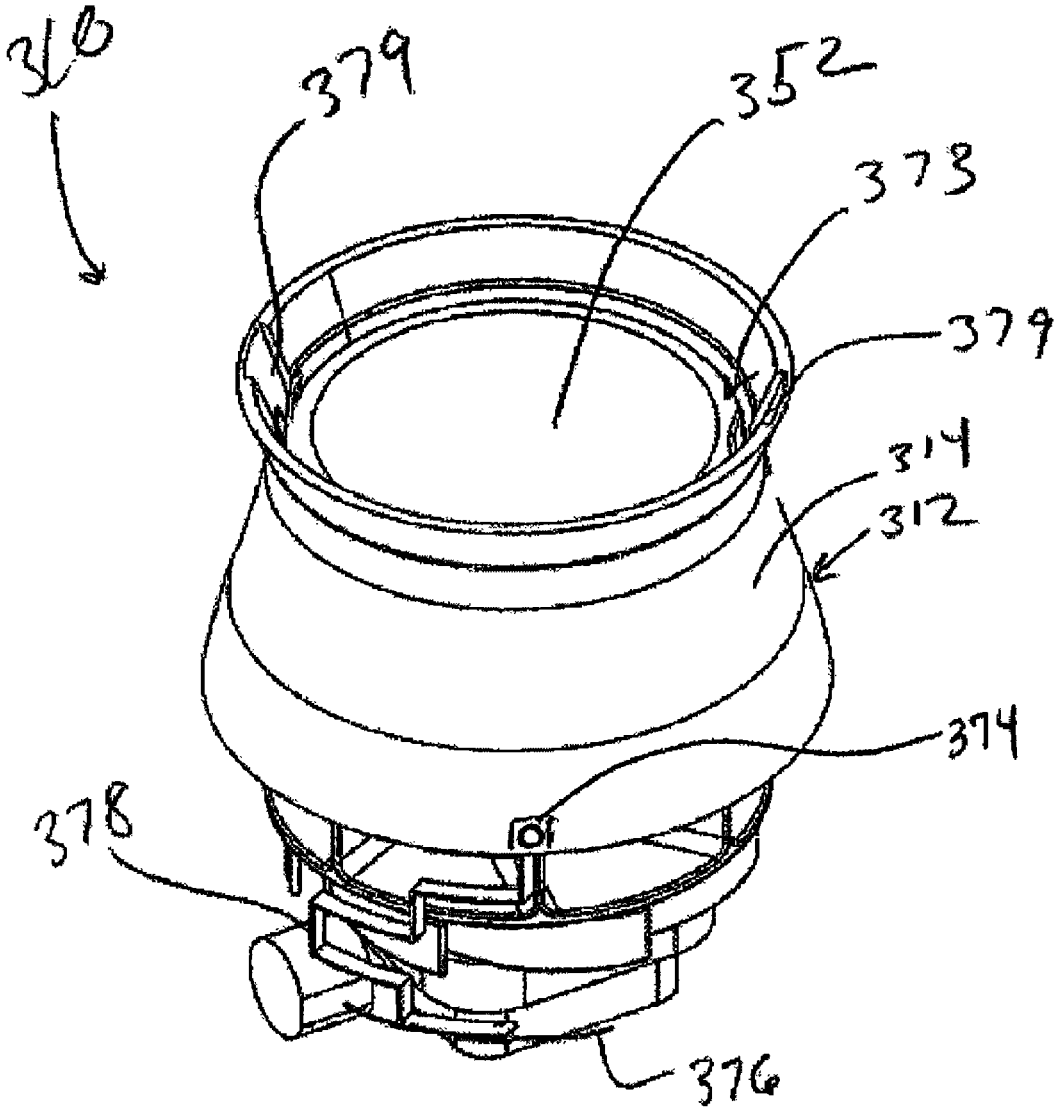
FIG. 25C is an isometric view of the dust and removal device of FIGS. 25A and 25B.

Turning now to FIGS. 25A-25C, a dust prevention and removal device 310 according to the present invention is shown. The device 310 includes a lock and key assembly 373 configured to prevent the use of unapproved filter media with the device 310. The lock and key assembly includes a magnet 374 disposed within an upper portion 314 of the housing 312.

Upper portion 314 is selectively rotatable about a vertical axis to power the device 310 on and off as will be described further below. A reed switch 376 is also included in the bottom portion 316 of the housing 312. The reed switch 376 is configured to switch the power to the device on and off. A conductor 378 is included in the housing 312 such that when the upper portion 314 of the housing 312 rotates, the magnet 374 comes into close proximity with the conductor 378. Accordingly, a magnetic field is transmitted through the conductor 378 to the reed switch 376 to power the device 310.

The housing 312 further includes a grill 344 for supporting a filter 352. A tab 379 is included to secure the frame of the filter 352 in place upon insertion of the filter 352. Tab 379 is configured to engage a portion of upper portion 314 in the absence of a filter 352 such that the upper portion 314 is incapable of rotating to activate the device 310. Accordingly, the device 310 will only operate when a filter 352 configured to engage the tab 379 is inserted. Once the filter 352 is inserted, the upper portion 314 of housing 312 may be freely rotated to the on position wherein the magnet 374 and the conductor 378 are positioned in communication with one another to activate the reed switch 376. Further, the tab 379 is configured to prevent removal of the filter 352 while the upper portion 314 of the housing 312 is rotated to engage the magnet 374 with the conductor 378. As such, the filter 352 can only be removed once the upper portion 314 is rotated to the off position wherein the magnet 374 is rotated out of communication with the conductor 378.

Figure 26A:
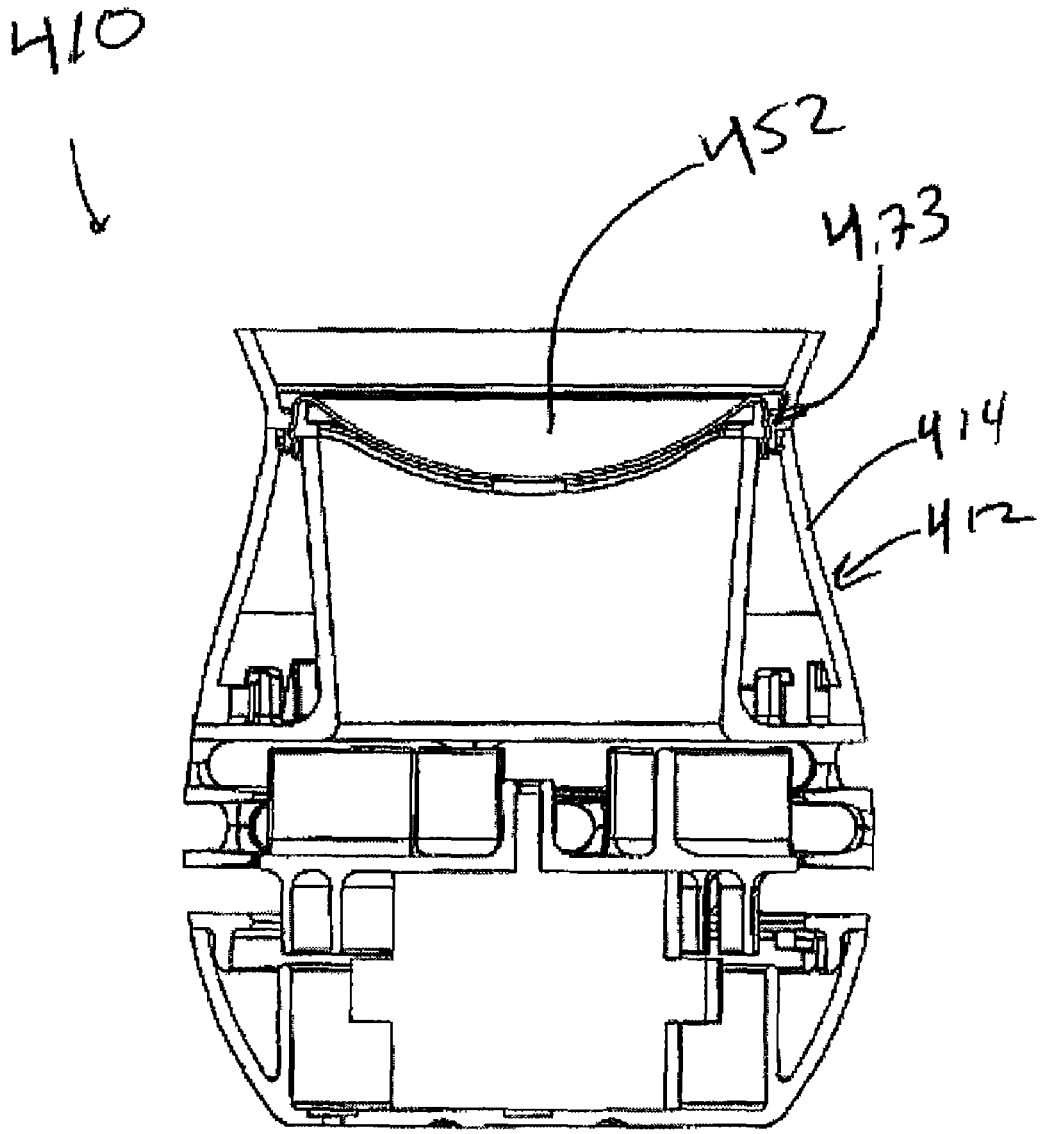
FIG. 26A is a side elevation cross section view of a dust prevention and removal device including a second embodiment of a lock and key assembly.
Figure 26B:
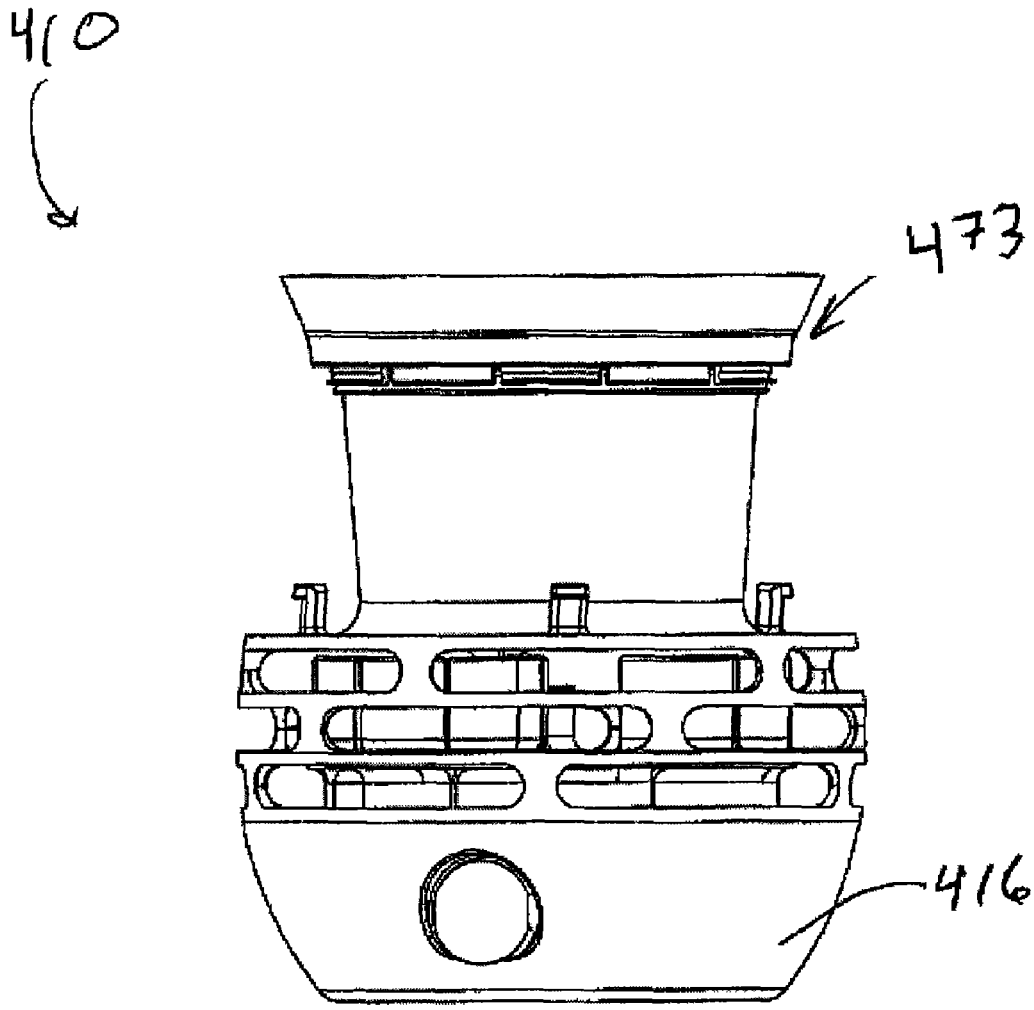
FIG. 26B is partial side elevation of the dust prevention and removal device of FIG. 26A.
Figure 26C:
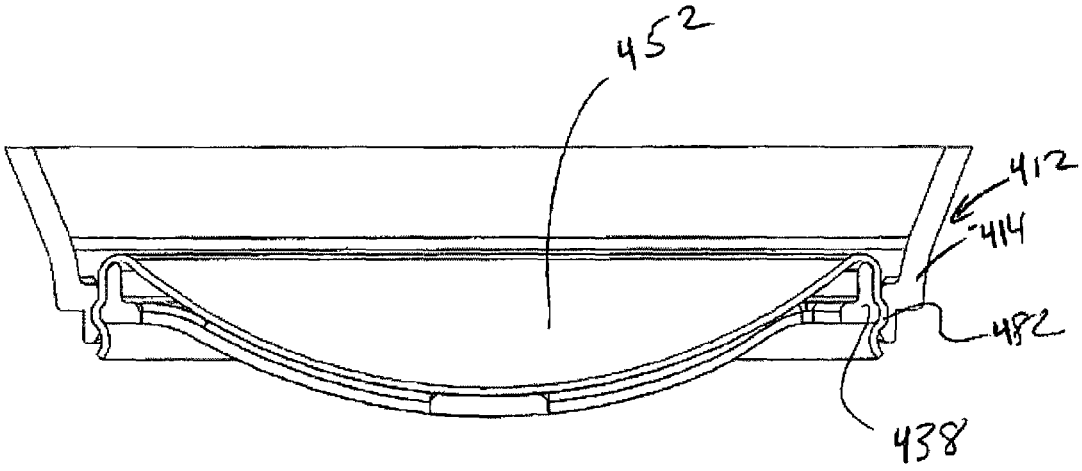
FIG. 26C is a partial cross section of the dust prevention and removal device of FIGS. 26A and 26B.

FIGS. 26A-26C illustrates a second embodiment of the lock and key assembly 473 of the device 410 of the present invention. In the current embodiment of the lock and key assembly, the upper portion 414 of the housing 412 secures a filter frame portion 482 between the upper projection 438 of the device 410. Accordingly, the filter 452 is snap-fitted therebetween to secure the filter 452 into place. In one embodiment (not shown) the filter 452 is heat stake bonded to the filter frame 482 and preferably requires a separation force from filter frame of more than 0.113 kilograms (kg.) (0.25 pounds (lbs.)) while the insertion and removal force of the filter frame holding the filter from the device is at least 0.9 kg (2 lbs.) and no greater than 1.8 kg (4 lbs.).

Figure 27A:
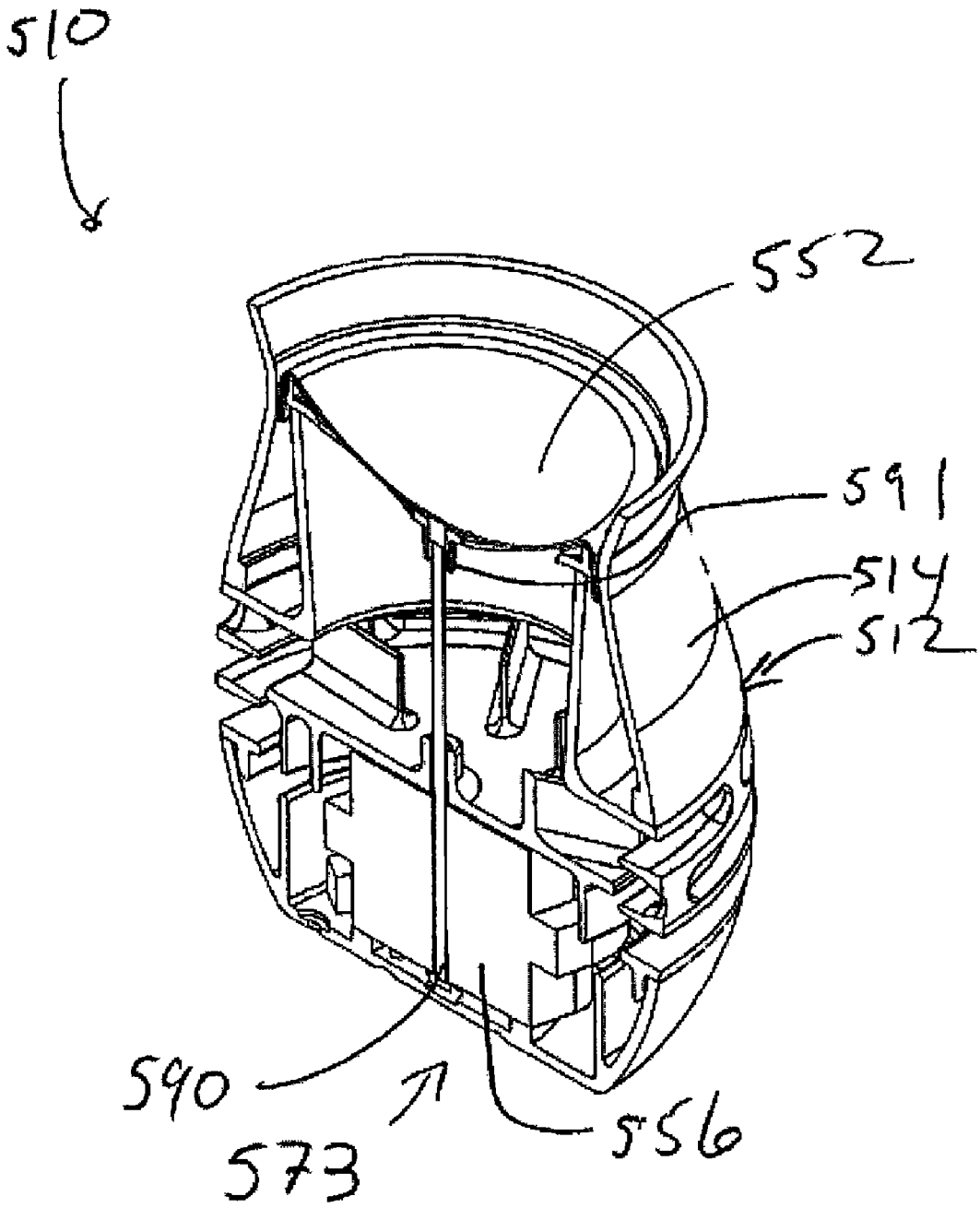
FIG. 27A is an isometric cross section view of a dust prevention and removal device including a third embodiment of a lock and key assembly.
Figure 27B:
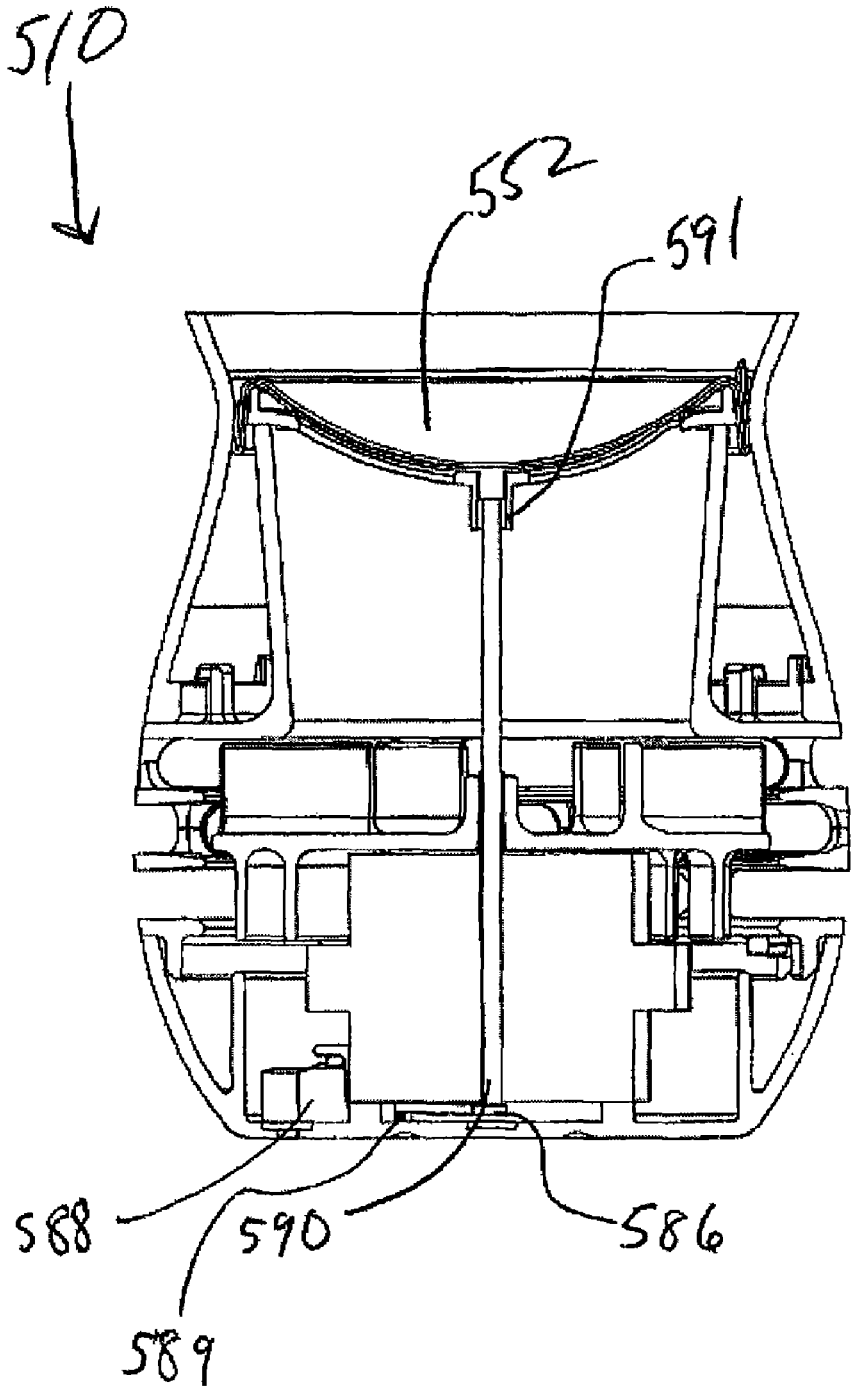
FIG. 27B is a side elevation cross section view of the dust prevention and removal device of FIG. 27A.
Figure 27C:
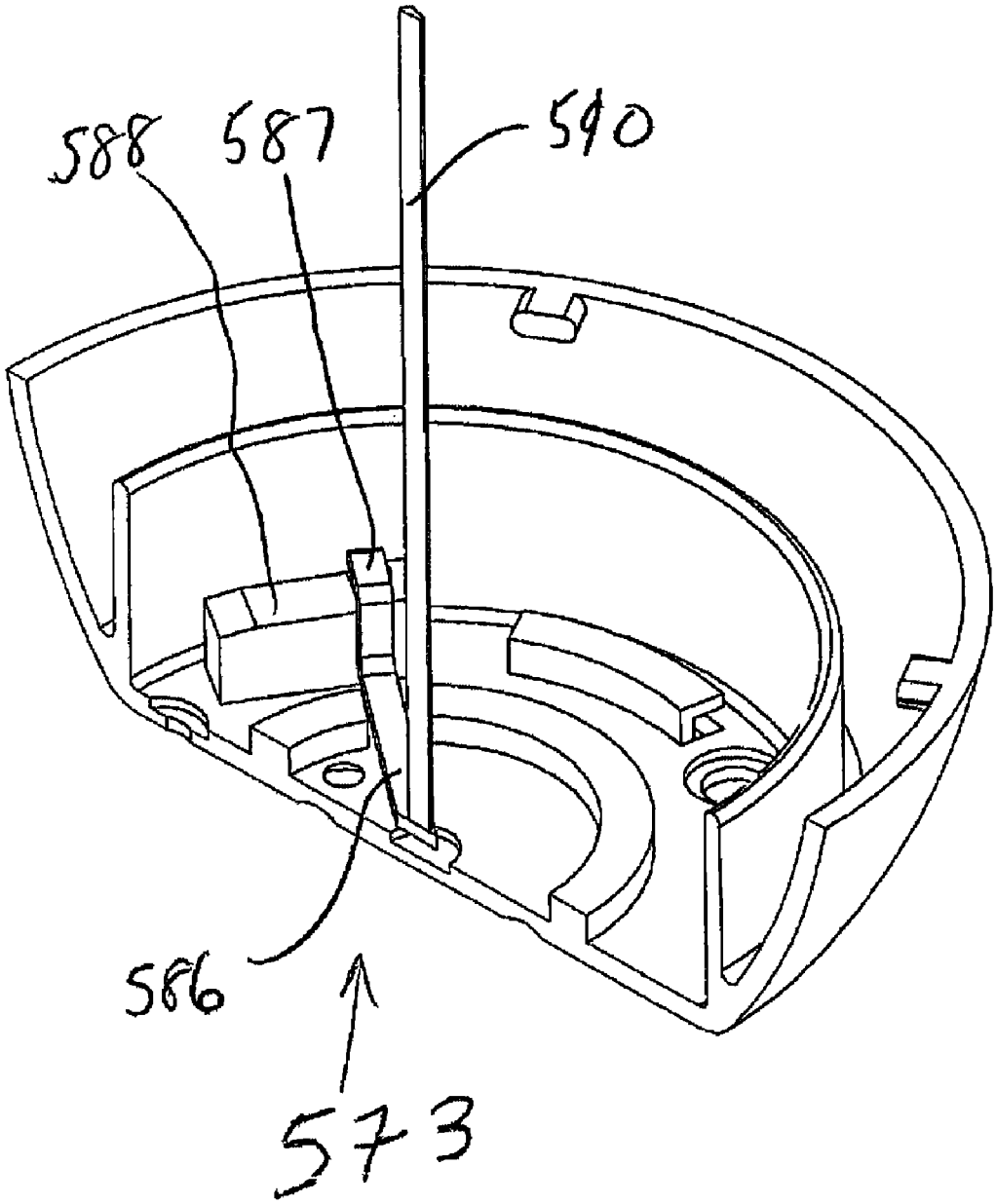
FIG. 27C is a partial isometric cross section view of the dust prevention and removal device of FIGS. 27A and 27B.

Turning to FIGS. 27A-27C, a third embodiment of a lock and key assembly 573 of the device 510 includes a lever 586 to actuate a switch 588. The lever is hingedly connected to an interior surface of the housing 512 preferably below the motor 556. A spring 589 is positioned between the lever and the bottom surface of the housing 512. An actuation rod 590 is longitudinally disposed through the center of the device 510 in communication with the motor 556 and lever 586. The actuation rod 590 is configured to engage a receiver 591 on the grill 544. The lock and key assembly 573 is configured such that when a filter 552 is pushed into place on the grill 544, the actuation rod 590 is engaged such that the actuation rod contacts the lever 586 and biases the lever 586 downwardly. An arm 587 of the lever 586 is configured to engage the switch 588 to thereby activate the device 510. Accordingly, the device 510 is incapable of operation without the presence of a filter media configured to fit the grill 544. In one embodiment the switch 588 is rated at 0.5-1.0 Amp 125 VAC and 0.25 Watt. The electrical life of the switch is preferably 10,000 operations at rated load with a repetition cycle of ten seconds on, five seconds off; and the mechanical life of the switch is preferably 10,000 cycles with a switching repetition rate of 60 cycles per minute. The operating force applied to move the switch is preferably 30+/−10 gf. Further, the switch 588 preferably has a dielectric constant between terminals (and between terminals and switch frame) of 500 VAC 50-60 Hz for one minute with a trip current not to exceed 0.5 mA; a contact resistance after 10,000 cycles of 30-200 Milliohms maximum; an insulation resistance between body and conductor (and between conductors not in contact) of 100 Megaohms minimum for one minute at 500 VAC; and a terminal strength of preferably 500 gf in any direction for one minute.

Figure 28:
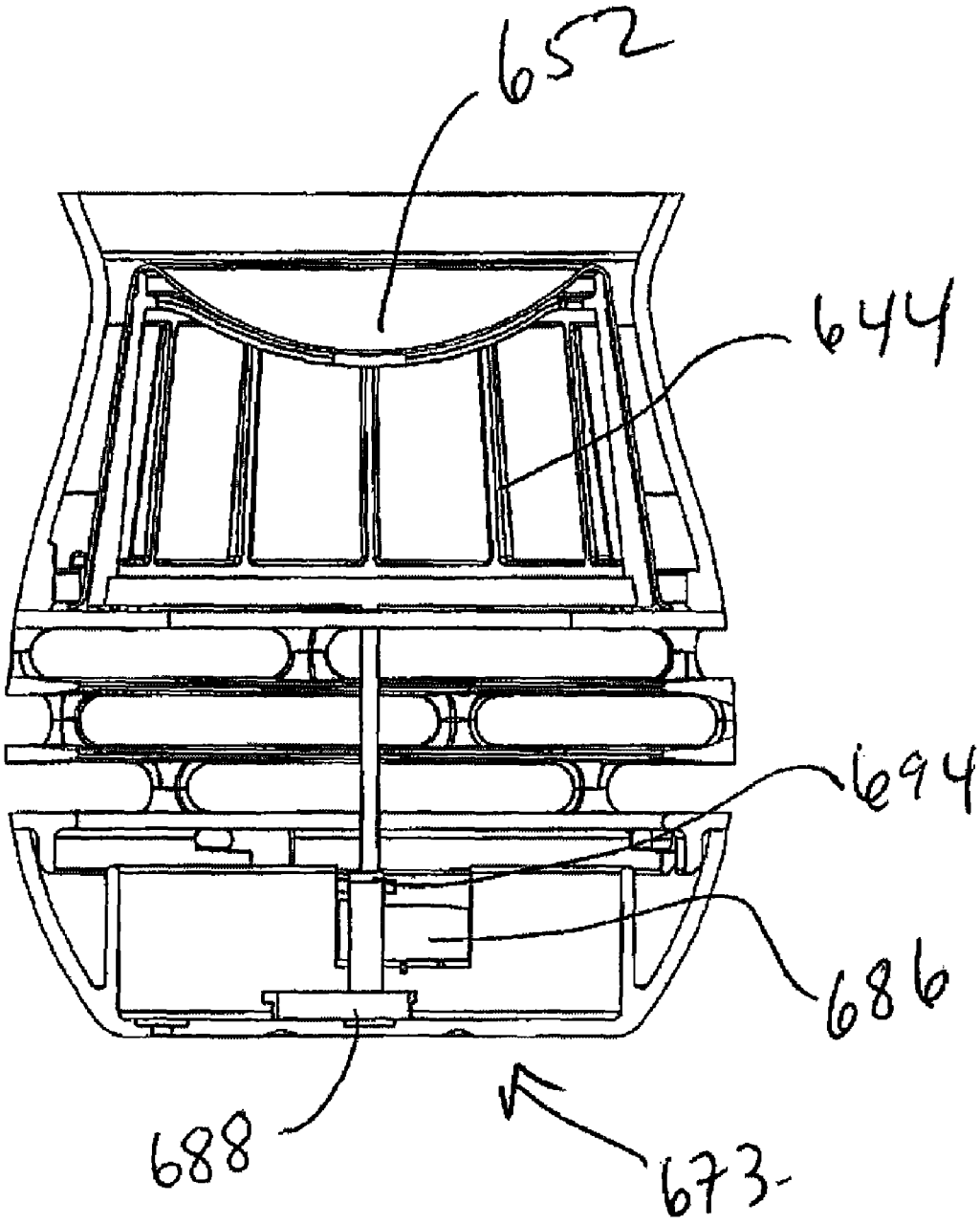
FIG. 28 is a side elevation cross section view of a dust prevention and removal device including a fourth embodiment of a lock and key assembly

Referring now to FIG. 28, a fourth embodiment of the lock and key assembly 673 includes switch 688 disposed within the device 610. The grill 644 includes a plunger 694 extending downwardly therefrom and terminating in a lever 686. Accordingly, upon insertion of the filter 652 into the grill 644, the plunger 694 is depressed thereby bringing the lever 686 into communication with the switch 688 to activate the device 610.

Figure 29A:
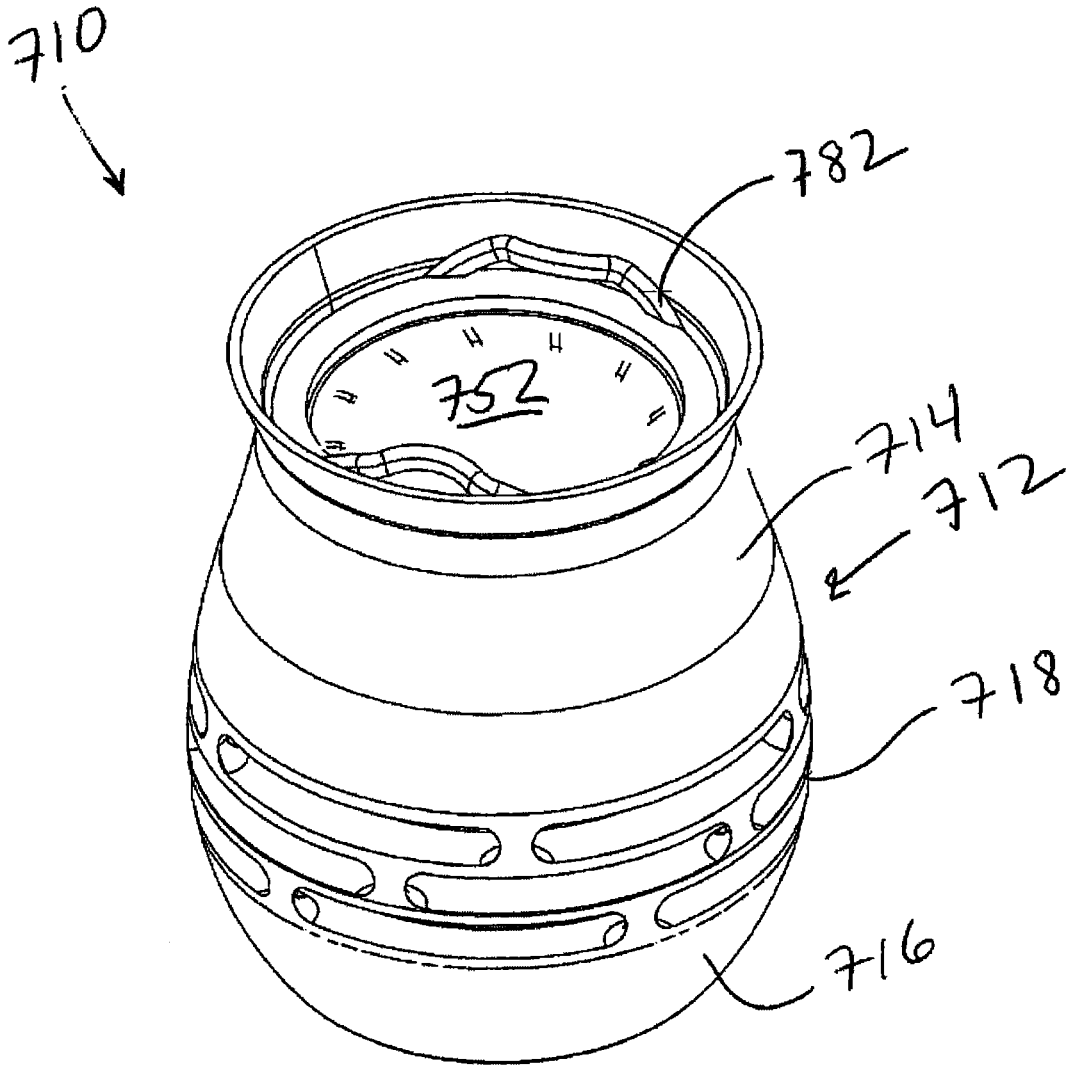
FIG. 29A is an isometric view of the dust prevention and removal device including a fifth embodiment of the lock and key assembly.
Figure 29B:
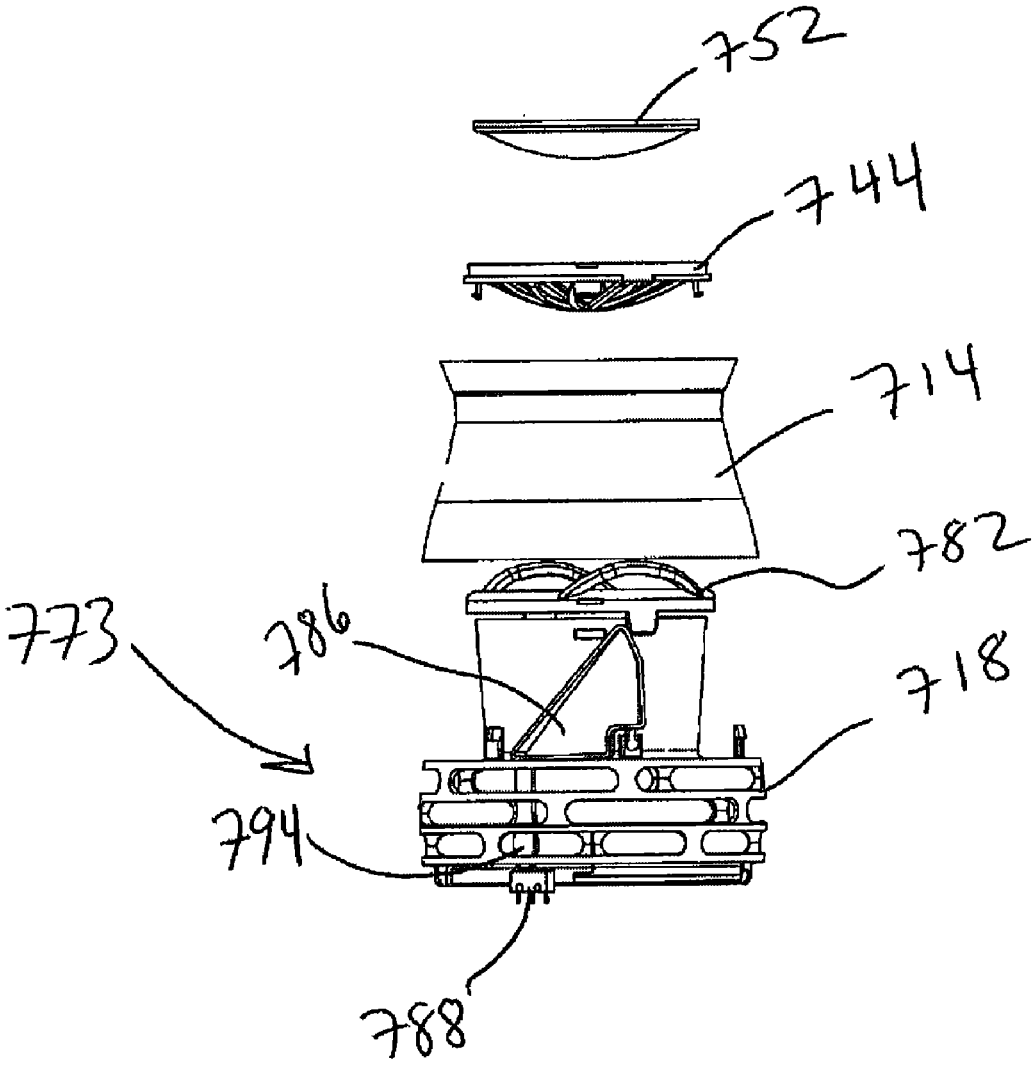
FIG. 29B is an exploded front elevation view of the dust and removal device according the present invention and including the fifth embodiment of the lock and key assembly of FIG. 29A.

FIGS. 29A-29B illustrate a fifth embodiment of the lock and key assembly 773 for the device 710 of the present invention. The device 710 includes a housing 712 having an upper portion 714 and lower portion 716 receiving an outlet grill 718 therebetween to complete the housing 712. A filter 752 is supported on an upper surface of the upper portion 714 for filtering air drawn in through the inlet as described herein. The filter 752 is supported by a filter frame 782 for securing to the housing 712. The filter 752 is supported on an inlet grill 744. The lock and key assembly 773 of the present embodiment includes a lever 786 having a triangular longitudinal cross section. The lever 786 is supported on an upper portion of the outlet 718 such that insertion of the filter 752 causes the filter frame 782 to contact the lever 786 and force it downwardly such that the lever 786 forces a plunger 794 downwardly and into contact with a switch 788 for powering the device 710.

As shown, the switch 788 is positioned in the lower portion 716 of the device 710 however in a preferred embodiment the switch 788 is positioned in the upper portion 714 of the housing or within the outlet grill 718 of the housing. Thus, plunger 794 may altogether be eliminated or otherwise altered to strike the switch 788 in accordance with the preferred embodiment.

Figure 30A:
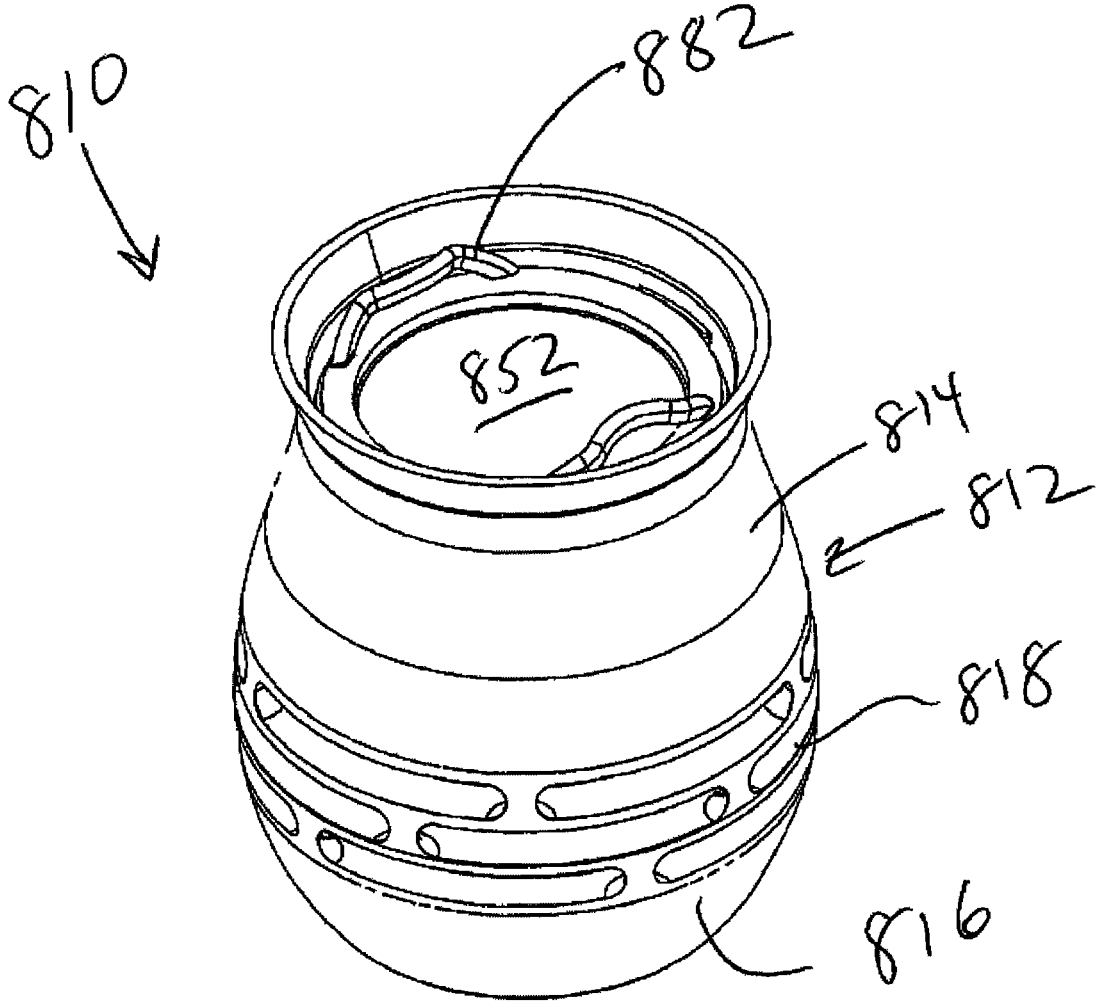
FIG. 30A is an isometric view of the dust prevention and removal device including a sixth embodiment of the lock and key assembly.
Figure 30B:
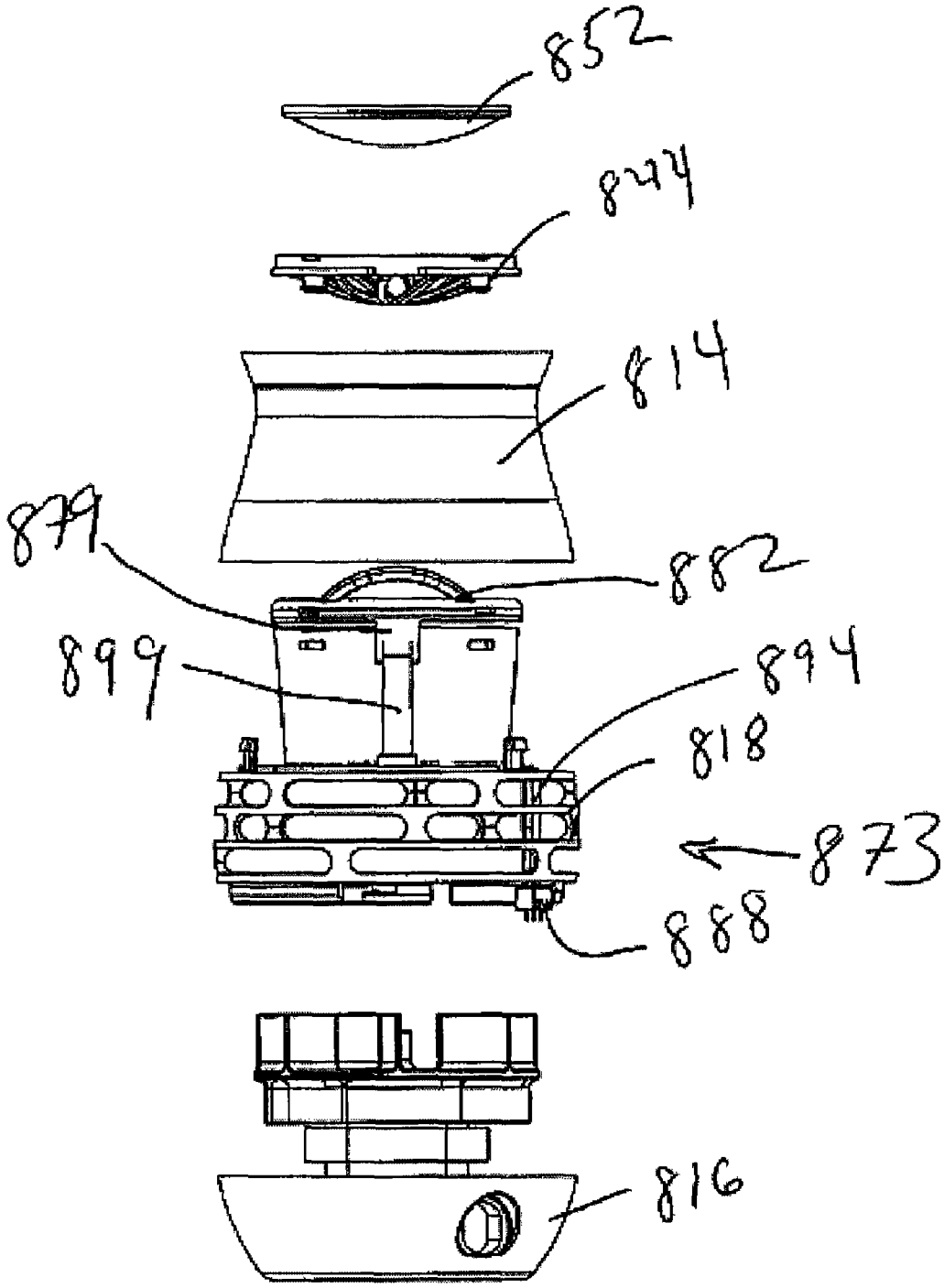
FIG. 30B is an exploded front elevation view of the dust and removal device according the present invention and including the sixth embodiment of the lock and key assembly of FIG. 30A.

Turning now to FIGS. 30A-30B, a sixth embodiment of the lock and key assembly 873 for the device 810 of the present invention is illustrated. The device 810 is assembled in accordance with the present invention and includes a housing 812 having an upper portion 814, lower portion 816 and an outlet grill 818 received therebetween. The device 810 includes a filter 852 supported on an inlet grill 844 and having a filter frame 882 for coupling the filter 852 to the housing 812 of the device 810. The lock and key assembly 873 includes a series of tabs 879 extending downwardly from a bottom surface of the filter frame 882. The tabs 879 are configured to engage a pair of stop clips 899 configured to prevent rotation of the upper portion 814 of the housing 812 in the absence of a filter frame. When the tabs 879 engage the stop clips 899, the upper portion 814 is free to rotate about a vertical axis with respect to the lower portion 816 to selectively engage a downwardly extending plunger 894 and activate a switch 888 to power the device 810.

As shown, the switch 888 is positioned in the lower portion 814 of the device 810 however in a preferred embodiment the switch 888 is positioned in the upper portion 814 of the housing or within the outlet grill 818 of the housing. Thus, plunger 894 may altogether be eliminated or otherwise altered to strike the switch 888 in accordance with the preferred embodiment.

Figure 31:
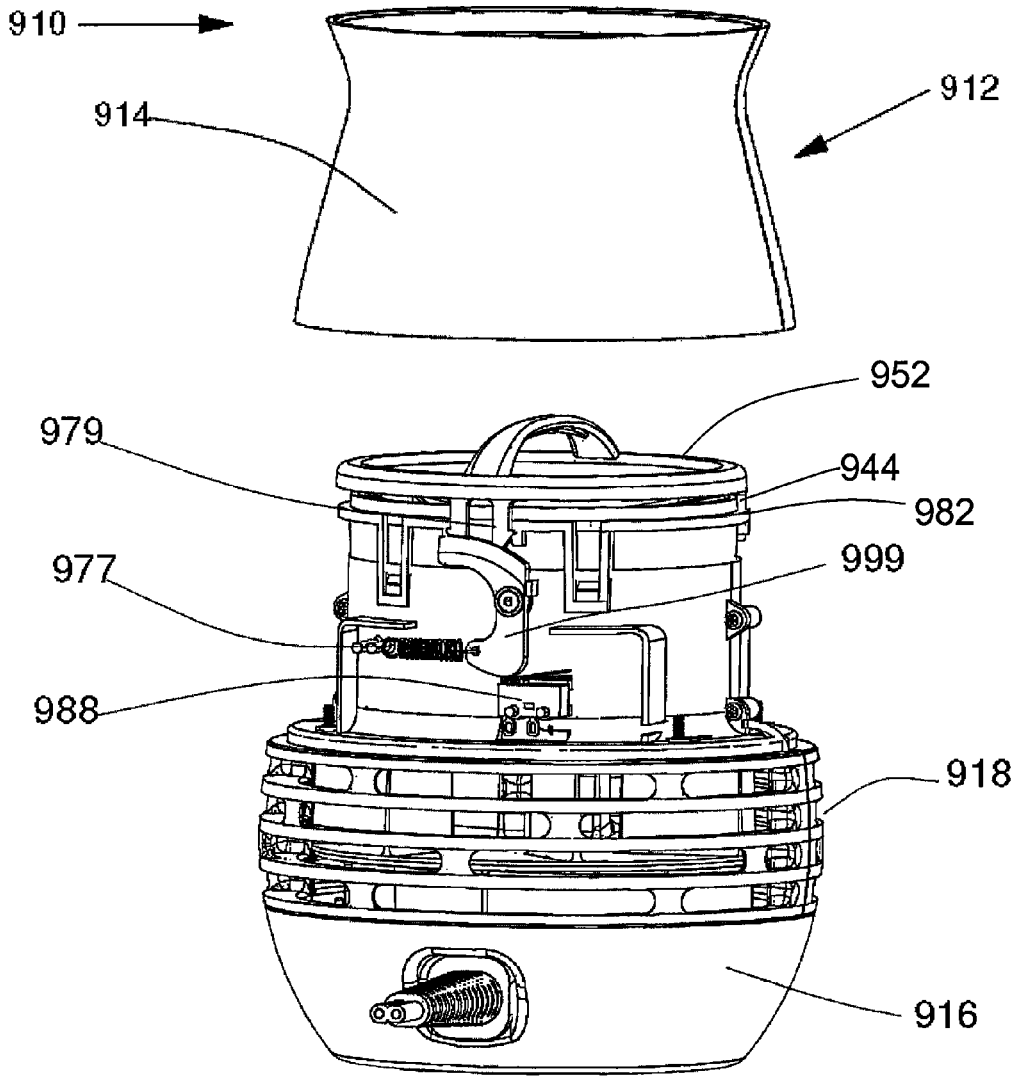
FIG. 31 is an exploded front elevation view of the dust and removal device according the present invention and including the seventh embodiment of the lock and key assembly.

Turning now to FIG. 31, a seventh embodiment of the lock and key assembly 973 for the device 910 of the present invention is illustrated. The device 910 is assembled in accordance with the present invention and includes a housing 912 having an upper portion 914, lower portion 916 and an outlet grill 918 received therebetween. The device 910 includes a filter 952 supported on an inlet grill 944 and having a filter frame 982 for coupling the filter 952 to the housing 912 of the device 910. The lock and key assembly 973 includes a series of tabs 979 extending downwardly from a bottom surface of the filter frame 982. The tabs 979 are configured to engage a plunger 999. When one of the tabs 979 engages the plunger 999, a switch 988 is activated to power the device 910. When the filter frame 982 is removed, the spring 977 restores the plunger 999 to a position which deactivates the switch 988 to power off the device 910.

The device 10 of the present invention may be practiced with any combination of the herein disclosed components. That is, the device 10 may include any one of the fan assemblies, housing constructions, filter types or lock and key assemblies in practicing the invention.

Alternative embodiments of the device 10 of the present invention may be similar to the devices shown in the following pending applications incorporated herein by reference: U.S. Ser. Nos. 11/442,940, 11/090,438, 29/257,940, 29/246,683, 29/248,293, US06/31126, Ser. Nos. 29/281,249 29/297,248, and 61/090,372.

Although the best mode contemplated by the inventors of carrying out the present invention is disclosed above, practice of the present invention is not limited thereto. It will be manifest that various additions, modifications, and rearrangements of the features of the present invention may be made without deviating from the spirit and scope of the underlying inventive concept.

Moreover, the individual components need not be formed in the disclosed shapes, or assembled in the disclosed configuration, but could be provided in virtually any shape, and assembled in virtually any configuration. Furthermore, all the disclosed features of each disclosed embodiment can be combined with, or substituted for, the disclosed features of every other disclosed embodiment except where such features are mutually exclusive. The dimensions shown in the figures are merely exemplary and it is understood that the invention is not limited to the exact dimensions shown.

It is intended that the appended claims cover all such additions, modifications, and rearrangements. Expedient embodiments of the present invention are differentiated by the appended claims.

What is claimed is:

1. A dust prevention and removal device comprising;

a housing defining an interior space and having a circumferential sidewall;

an inlet disposed on the housing, the inlet defining a frame;

an outlet circumferentially disposed on the sidewall of the housing;

a motor in communication with a fan for driving the fan to draw air into the interior space through the inlet and out through the outlet;

a filter secured in the frame of the inlet;

wherein the filter and the frame are sized and shaped to cooperate with one another and the device such that the device will not operate unless the filter is secured to the frame.

2. The dust prevention and removal device of claim 1, wherein the fan comprises an upper portion and a lower portion and wherein the upper and lower portion have a plurality of blades disposed thereon for drawing air in through the inlet and out through the outlet.

3. The dust prevention and removal device of claim 2, wherein the blades on the upper portion of the fan are radially disposed thereon and configured for drawing air in through the inlet.

4. The dust prevention and removal device of claim 3, wherein the blades on the lower portion of the fan are curved and circumferentially disposed about the lower portion in an overlapping configuration.

5. The dust prevention and removal device of claim 4, wherein the blades on the lower portion are configured to circulate air through the interior space occupied by the motor to thereby keep the motor cool.

6. The dust prevention and removal device of claim 5, wherein the blades on the lower portion are configured to prevent access by a user to the motor.

7. The dust prevention and removal device of claim 2, wherein the plurality of blades on the upper portion and the lower portion of the fan comprise a prime number of blades.

8. The dust prevention and removal device of claim 1, further comprising a lock and key assembly for selective engagement with a power source so as to selectively provide power to the dust prevention and removal device, the lock and key assembly comprising:

a magnet disposed in an upper portion of the housing;

a conductor disposed in the housing;

a reed switch disposed in the housing in communication with the conductor;

wherein upon securing of a filter to the frame, the upper portion of the housing is rotatable with respect to a lower portion of the housing to position the magnet in communication with the conductor such to complete a circuit configured to power the device.

9. The dust prevention and removal device of claim 8, further comprising a lever engaged with the frame and configured to prevent rotation of the upper portion of the housing in the absence of a filter.

10. The dust prevention and removal device of claim 9, wherein the lever is disengaged upon insertion of the filter into the frame.

11. The dust prevention and removal device of claim 1, further comprising a lock and key assembly for selective engagement with a power source so as to selectively provide power to the dust prevention and removal device, the lock and key assembly comprising an actuator rod longitudinally disposed through a center of the interior space of the device and having an upper end thereof secured to the frame;

a lever hingedly coupled to a bottom surface of the interior space of the device and having an arm biased upwardly therefrom by a compressible member;

a switch positioned to be actuatable by the lever arm for providing power to the device;

wherein securing the filter within the frame applies a downward force upon the actuator rod such that a lower end thereof biases the lever arm downwardly and into contact with the switch to power the device.

12. The dust prevention and removal device of claim 1, further comprising a lock and key assembly for selective engagement with a power source so as to selectively provide power to the dust prevention and removal device, the lock and key assembly comprising a downwardly extending rod secured to the frame; and a switch actuatable by the rod for powering the device;

wherein securing the filter within the frame applies a downward force to the rod such that the rod actuates the switch to supply power to the device.

13. The dust prevention and removal device of claim 1, wherein the device is prevented from operating unless the filter is secured to the frame by a lock and key assembly comprising:

a downwardly extending tab secured to the frame;

a plunger and spring assembly; and a switch actuatable by the plunger for powering the device;

wherein securing the filter within the frame applies a downward force to the tab such that the tab communicates with the plunger which actuates the switch to supply power to the device; and wherein removing the filter from the frame removes the downward force from the plunger thereby causing the spring to restore the plunger to a position which deactivates the switch.

14. The dust prevention and removal device of claim 1, wherein the filter comprises one of a dome or concave shape for increasing an effective surface area of the filter.

15. The dust prevention and removal device of claim 1, wherein the filter includes a plurality of folds configured to increase an effective surface area of the filter.

16. The dust prevention and removal device of claim 1, wherein the filter is impregnated with one of a tacky and deodorizing chemical.

17. A dust prevention and removal device comprising;

a housing defining an interior space;

an air inlet disposed on the housing for drawing air into the interior space, the air inlet defining a frame on an upper portion of the housing;

an air outlet disposed on the housing for expelling the air wherein the airflow is expelled around substantially 360 degrees of the circumference;

a filter secured to the housing within the frame; and a motor in communication with a fan for driving the fan to draw air into the interior space through the inlet and out through the outlet;

18. A dust prevention and removal device comprising;

a housing defining an interior space;

an air inlet disposed on the housing and in communication with the interior space, the inlet being positioned on an upper portion of the housing for drawing air into the interior space along a substantially vertical axis;

an air outlet circumferentially disposed around the housing and in communication with the interior of the housing for expelling air from the interior space to a surrounding area along a substantially horizontal axis, and wherein the air outlet comprises a plurality of horizontally extending rungs circumferentially supported by a plurality of spaced vertical struts wherein the rungs and struts define a plurality of apertures;

a filter secured to the housing and positioned between the inlet and the interior space, the filter having a frame configured to cooperate with a portion of the inlet for supporting the filter therein;

a fan positioned within the interior space, wherein the fan comprises an upper surface and a lower surface, the upper and lower surfaces each having a plurality of blades radially disposed thereon;

a motor in communication with a power source and having an output shaft coupled to the fan for driving the fan; and a lock and key device coupled to the filter and selectively engageable with the motor to operate the dust prevention device.

19. The dust prevention and removal device of claim 18, wherein the lock and key device comprises a plurality of taps extending downwardly from a bottom surface of the filter frame and configured to selectively engage a plunger for actuating a switch to provide power to the device.

20. The dust prevention and removal device of 19, further comprising a spring selectively engageable with the plunger, wherein removal of the filter frame biases the spring against the plunger to a position wherein the switch is deactivated and power is removed from the device.

* * * * *